US012560398B2

(12) United States Patent
Ingram et al.

(10) Patent No.: US 12,560,398 B2
(45) Date of Patent: Feb. 24, 2026

(54) BIPOD

(71) Applicant: Swagger, LLC, Grand Island, NE (US)

(72) Inventors: Don Ingram, Grand Island, NE (US); Paul Heflin, Grand Island, NE (US); Mike Necessary, Grand Island, NE (US); Casey Macken, Grand Island, NE (US); Aaron Keller, Grand Island, NE (US)

(73) Assignee: Swagger, LLC, Grand Island, NE (US)

( * ) Notice: Subject to any disclaimer, the term of this patent is extended or adjusted under 35 U.S.C. 154(b) by 0 days.

(21) Appl. No.: 18/100,927

(22) Filed: Jan. 24, 2023

(65) Prior Publication Data

US 2023/0160652 A1 May 25, 2023

Related U.S. Application Data

(63) Continuation of application No. 16/737,665, filed on Jan. 8, 2020, now abandoned, which is a continuation-in-part of application No. 15/856,370, filed on Dec. 28, 2017, now abandoned.

(60) Provisional application No. 62/789,949, filed on Jan. 8, 2019, provisional application No. 62/448,034, filed on Jan. 19, 2017, provisional application No. 62/439,694, filed on Dec. 28, 2016.

(51) Int. Cl.
*F41A 23/10* (2006.01)

(52) U.S. Cl.
CPC ..... *F41A 23/10* (2013.01)

(58) Field of Classification Search
CPC ..... F41A 23/10; F41A 23/08; F16M 11/16; F16M 11/32
See application file for complete search history.

(56) References Cited

U.S. PATENT DOCUMENTS

| | | | | |
|---|---|---|---|---|
| 2,420,267 | A * | 5/1947 | Sefried | F41A 23/08 42/76.02 |
| 5,029,407 | A * | 7/1991 | Kirkpatrick | F41A 23/10 42/94 |
| 6,062,527 | A | 5/2000 | Nygren, Jr. | |
| 6,289,622 | B1 * | 9/2001 | Desch, Jr. | F41A 23/10 42/94 |
| 7,770,320 | B1 * | 8/2010 | Bartak | F41C 23/16 42/72 |
| 7,841,122 | B1 * | 11/2010 | Hansen | F41A 23/08 24/595.1 |
| 8,402,684 | B1 | 3/2013 | Beltz | |
| 9,227,687 | B2 | 1/2016 | Delgatty et al. | |
| 9,255,751 | B1 * | 2/2016 | Beltz | F41A 23/10 |

(Continued)

FOREIGN PATENT DOCUMENTS

| | | | | |
|---|---|---|---|---|
| DE | 202006001450 U | 6/2007 | | |
| WO | WO-2017147689 A1 * | 9/2017 | | F41A 23/08 |
| WO | 2019035751 A1 | 2/2019 | | |

*Primary Examiner* — Terrell L Mckinnon
*Assistant Examiner* — Ding Y Tan
(74) *Attorney, Agent, or Firm* — Braxton Perrone, PLLC; Bobby W. Braxton; Gregory Perrone

(57) ABSTRACT

A system for a bipod. The system includes a coupler to couple at least one leg to a firearm. The leg includes one flexible joint which allows the leg to flex about a flexible joint. The system allows conversion of the flexible leg from a flexible position to a rigid position whereby flexing about the flexible joint is prevented. A lock is manipulated to convert the leg from rigid to flexible.

9 Claims, 25 Drawing Sheets

(56) References Cited

U.S. PATENT DOCUMENTS

| | | | | |
|---|---|---|---|---|
| 9,784,521 | B2 * | 10/2017 | Bartak | F41A 23/10 |
| 10,352,644 | B2 * | 7/2019 | Ravnaas | F41C 23/22 |
| 10,718,588 | B2 * | 7/2020 | Gyurec | F16M 11/26 |
| 11,150,046 | B2 * | 10/2021 | Keller | F41A 23/10 |
| 11,168,830 | B2 * | 11/2021 | Bryant | F16M 11/26 |
| 2007/0094911 | A1 * | 5/2007 | Rush | F16M 13/04 224/150 |
| 2008/0307689 | A1 * | 12/2008 | Dotson | F41A 23/06 42/94 |
| 2009/0038200 | A1 | 2/2009 | Keng | |
| 2010/0269393 | A1 | 10/2010 | Bean | |
| 2011/0247256 | A1 | 10/2011 | Lickteig | |
| 2011/0265366 | A1 * | 11/2011 | Hinds, Jr. | F41G 11/003 42/94 |
| 2012/0085012 | A1 * | 4/2012 | Potterfield | F41A 23/10 42/94 |
| 2013/0174463 | A1 * | 7/2013 | Hinds | F41C 27/22 42/94 |
| 2013/0232844 | A1 * | 9/2013 | Gallo | F41A 23/16 42/94 |
| 2014/0130393 | A1 * | 5/2014 | Antell | F41A 23/10 42/94 |
| 2014/0190059 | A1 * | 7/2014 | Ballard | F41A 23/08 42/94 |
| 2018/0259287 | A1 * | 9/2018 | Palu | F41A 23/10 |
| 2019/0360634 | A1 * | 11/2019 | Hatch | F16B 7/1409 |
| 2020/0103196 | A1 * | 4/2020 | Keller | F16M 11/041 |
| 2022/0034339 | A1 * | 2/2022 | Keller | F16B 2/02 |
| 2022/0282945 | A1 * | 9/2022 | Makarov | F41A 15/20 |

* cited by examiner

BIPOD

PRIORITY

This application is a continuation of U.S. Non-Provisional patent application Ser. No. 16/737,665 filed Jan. 8, 2020, which claims priority to U.S. Provisional Application No. 62/789,949 filed Jan. 8, 2019 and is also a continuation-in-part of U.S. Non-Provisional application Ser. No. 15/856,370, which claims priority to U.S. Provisional Application No. 62/439,694 filed Dec. 28, 2016 and U.S. Provisional Application No. 62/448,034 filed Jan. 19, 2017, the entirety of which is hereby incorporated by reference.

BACKGROUND OF THE INVENTION

Technical Field

The present invention relates to firearms and crossbows, and more particularly to a bipod firearm support that can function as a stand, a brace against the user's body, or a handle.

Description of Related Art

Bipod supports have long been used to support the forward end or muzzle of a rifle or shotgun, or a crossbow, during the firing thereof in an effort to "steady" or "stabilize" the weapon to increase the shooter's accuracy. The bipod supports are also useful to support the muzzle of the rifle above the ground or other supporting surface during periods when the rifle is not being fired or is being cleaned. Some bipods have legs of a fixed length, while other bipods have length adjustable legs. If the legs of the bipod have fixed lengths, the firearm will be supported at a predetermined height above the ground. Thus, the shooter cannot adjust the height of the firearm. If the legs of the bipod are length adjustable, the height of the firearm above the ground can only be changed by manually adjusting the lengths of both legs of the bipod. Further, if the shooter is shooting on a side hill, the firearm will be canted, which not only makes it difficult for the shooter to sight the firearm, but the canting of the firearm will affect the accuracy thereof.

If the bipod has adjustable length legs, and the bipod is used on a side hill, the firearm will be canted unless one of the legs of the bipod is shortened or lengthened to maintain the firearm in a non-canted position. The fact that one of the legs must be length adjusted may result in the shooter missing an opportunity to shoot a game animal, enemy, or other target.

Therefore, a need exists for a new and improved bipod firearm support that enables the individual legs of the bipod to be pivotally moved with respect to the support to compensate for a side hill situation, an uphill situation or a downhill situation, or to lower the support. In this regard, the various embodiments of the present invention substantially fulfill at least some of these needs. In this respect, the bipod firearm support according to the present invention substantially departs from the conventional concepts and designs of the prior art, and in doing so provides an apparatus primarily developed for the purpose of enabling the individual legs of the bipod to be pivotally moved with respect to the support to compensate for a side hill situation, an uphill situation or a downhill situation, or to lower the support.

SUMMARY

The present invention provides an improved bipod firearm support, and overcomes the above-mentioned disadvantages and drawbacks of the prior art. As such, the general purpose of the present invention, which will be described subsequently in greater detail, is to provide an improved bipod firearm support that has all the advantages of the prior art mentioned above.

To attain this, the preferred embodiment of the present invention essentially comprises a body defining a first bore and a second bore, a first offset bore segment associated with the first bore, and angularly offset with respect to the first bore, a second offset bore segment associated with the second bore, and angularly offset with respect to the second bore, a first elongated leg adapted to be closely and removably received in the first bore for stowage, a second elongated leg closely and removably received in the second bore for stowage, each of the first and second legs having a base segment sized to be closely received in the associated offset bore segment for deployment, and each of the first and second legs having an elongated leg portion connected to the base segment by way of a connection facility that enables angular flexure of each elongated leg portion with respect to the base segment. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
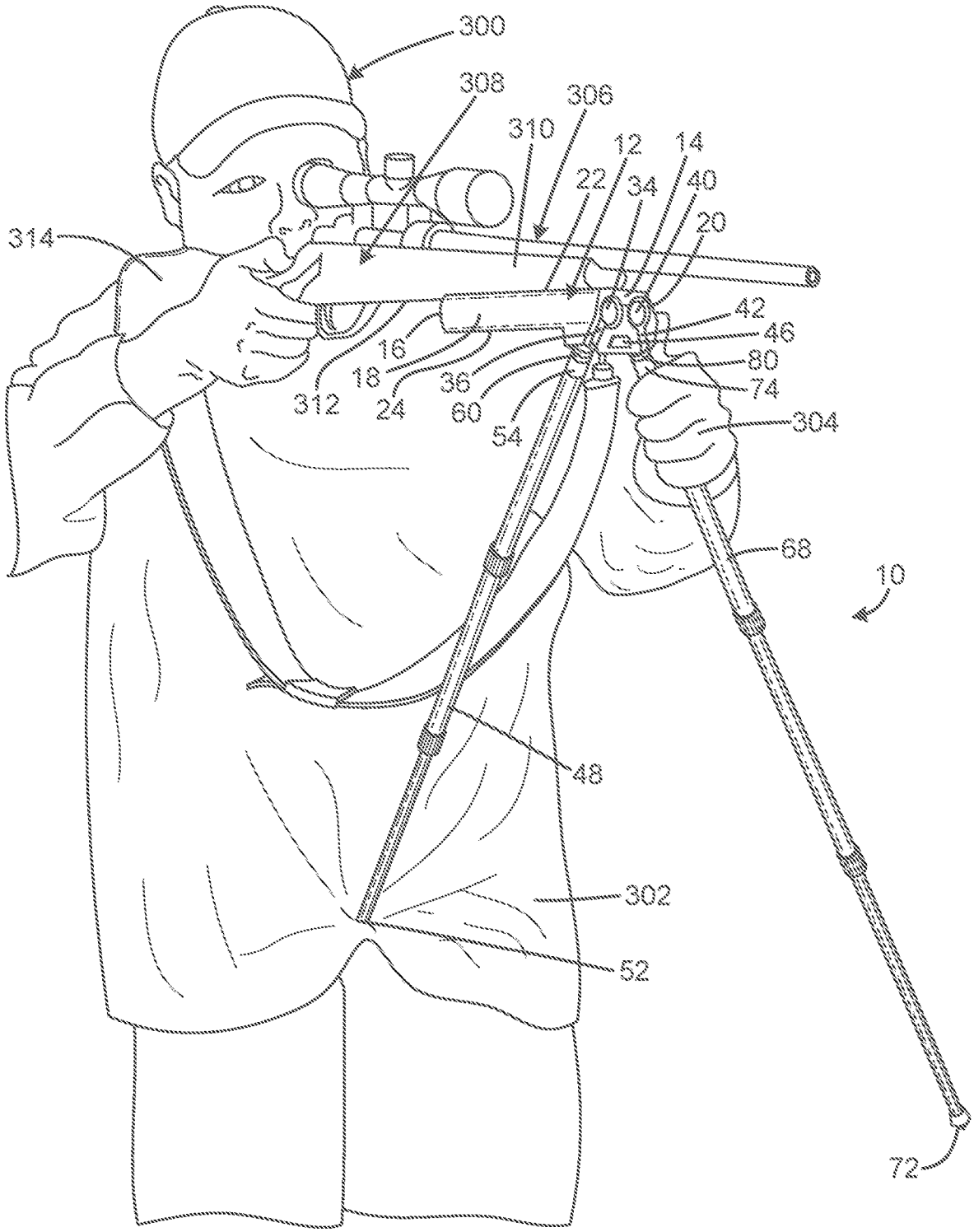
FIG. 1 is a front perspective view of the current embodiment of the bipod firearm support constructed in accordance with the principles of the present invention in use supporting a rifle.

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

An embodiment of the bipod firearm support of the present invention is shown and generally designated by the reference numeral 10.

FIGS. 1-9 illustrates the improved bipod firearm support 10 of the present invention. More particularly, in FIG. 1 the bipod firearm support is depicted in use by a shooter 300 supporting a firearm 306, which is a rifle in the current embodiment, but can also be a shotgun, crossbow, or an optical instrument such as a monocular. Thus, while a rifle has been described, this is for illustrative purposes only and should not be deemed limiting. As noted, the bipod support can be used on virtually any firearm including rifles, shotguns, handguns, etc. The bipod support can also be used in bows, crossbows, and other hunting tools. In one embodiment the bipod support can be used for virtually any tool which is used to accurately launch one projectile toward a target. The rifle has a forend 310 with a bottom 312 and a butt 314. The bipod firearm support has a body 12 with a front 14, rear 16, right side 18, left side 20, top 22, and bottom 24. The front of the body defines a right bore 34 and a left bore 40 that are parallel to one another in the current embodiment. However, the right and left bore can also be at an angle to one another in alternative embodiments to accommodate alternative support leg designs and/or to avoid the bore of the attached firearm. A right bore segment 38 and a left bore segment 44 are in communication with, perpendicular to, and angularly offset with respect to their respective bores in the current embodiment. However, the bore segments can also be at angles other than 90° to their respective bores in alternative embodiments. A right slot 36 and a left slot 42 are in communication with their respective bores and bore segments. A button 46 actuates latches located within the right and left bore segments, which will be discussed in detail in the description of FIGS. 13-15.

The right support leg 48 has a top 50, a bottom 52, and a plurality of elongated segments telescopically interacting with each other to provide an adjustable length. The top of the right support leg is connected to the bottom 58 of a right end cap 54. The top 56 of the right end cap is connected to a connection facility that enables angular flexure of the right support leg, which is a right coil spring 60 that is a cylindrical member having a diameter substantially the same as that of the right support leg in the current embodiment. The right coil spring is also connected to the bottom 66 of a right base segment 62. The right coil spring returns the right support leg and right end cap to axial alignment with the right base segment in the absence of a deflecting force. The top 64 of the right base segment receives one end 92 of right elastic cord 88.

The left support leg 68 has a top 70, a bottom 72, and a plurality of elongated segments telescopically interacting with each other to provide an adjustable length. The top of the left support leg is connected to the bottom 78 of a left end cap 74. The top 76 of the left end cap is connected to a connection facility that enables angular flexure of the left support leg, which is a left coil spring 80 that is a cylindrical member having a diameter substantially the same as that of the left support leg in the current embodiment. The left coil spring is also connected to the bottom 86 of a left base segment 82. The left coil spring returns the left support leg and left end cap to axial alignment with the left base segment in the absence of a deflecting force. The top 84 of the left base segment receives one end 100 of left elastic cord 96.

Figure 3:
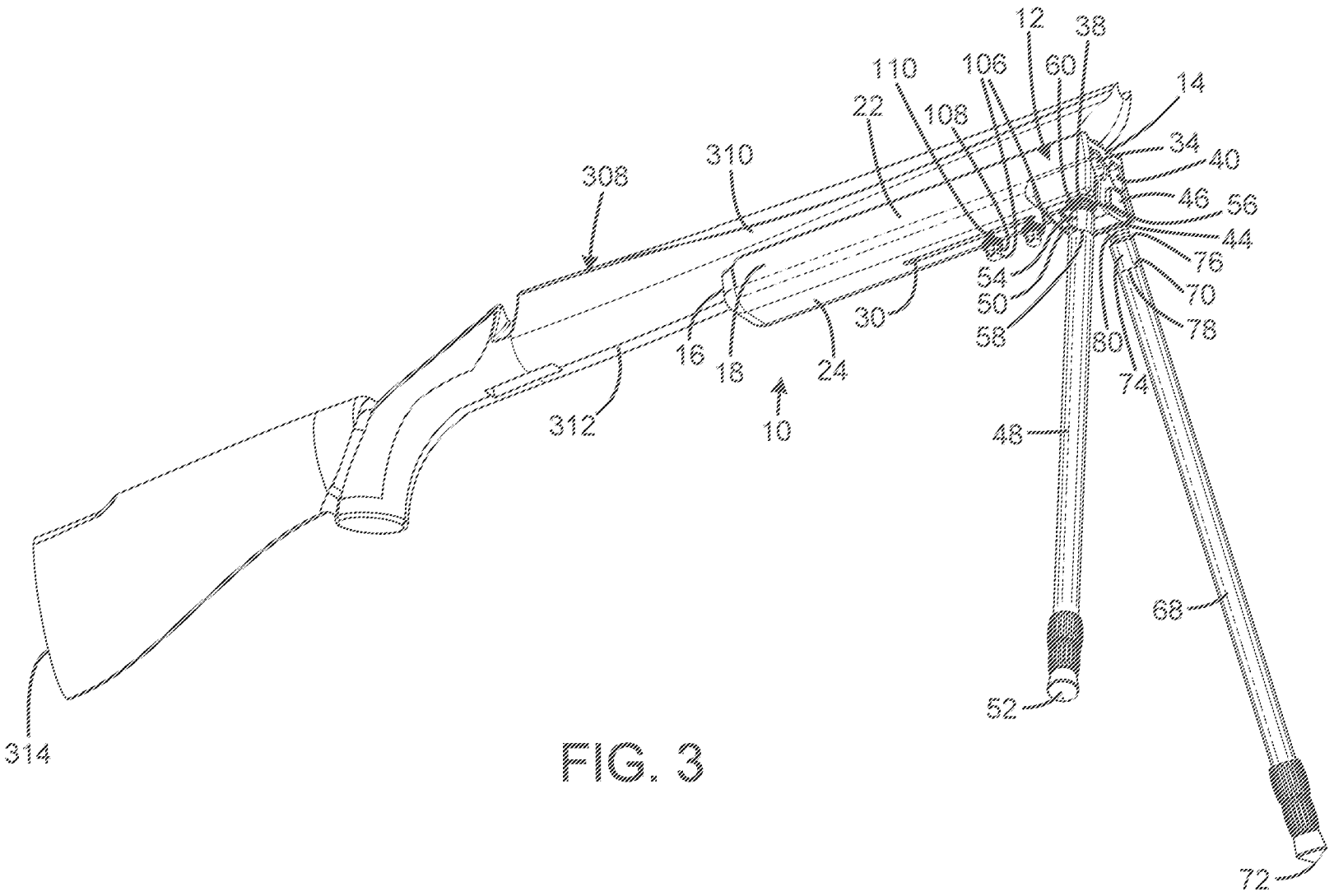
FIG. 3 is a bottom isometric view of the current embodiment of the bipod firearm support of FIG. 1 mounted on the forend of a rifle or shotgun with the support legs in an extended position.

In FIGS. 1 and 3, the right support leg 48 and left support leg 68 are depicted in an extended position with the right base segment 62 received within the right bore segment 38 and the left base segment 82 received within the left bore segment 44. In FIG. 1, the shooter is illustrated in the standing position with his left hand 304 using the left support leg 68 as a handle by grasping the left support leg. The bottom 52 of the right support leg 48 is braced against the shooter's body 302. The shooter has compensated for being in the standing position by tucking the bipod into his body to make an offhand shot. The bipod firearm support 10 can also be used to support a firearm with the shooter in a prone or seated position.

Figure 2:
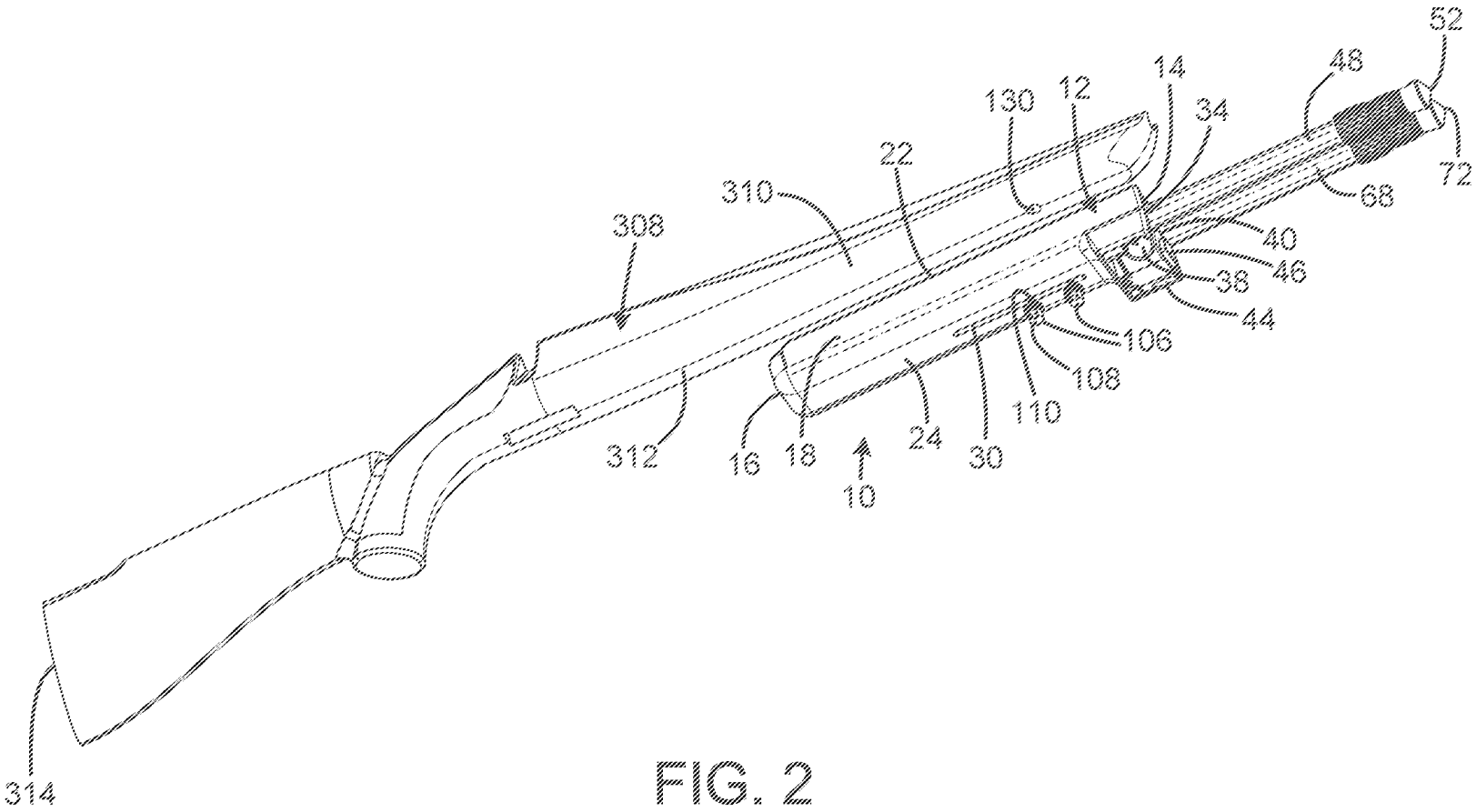
FIG. 2 is an exploded bottom isometric view of the current embodiment of the bipod firearm support of FIG. 1 illustrating how the current invention is mounted on the forend of a rifle, shotgun, or crossbow with the support legs in a stowed position.

In FIG. 2, the right support leg 48 and left support leg 68 are depicted in a stowed position with the right base segment 62, right coil spring 60, right end cap 54, and an upper portion of right support leg 48 received within the right bore 34 and the left base segment 82, left coil spring 80, left end cap 74, and an upper portion of left support leg 68 received within the left bore 40. The body 12 is shown detached from the bottom 312 of the forend 310 to expose threaded aperture 130 in the bottom of the forend. The head portions 108 of studs 106 are shown protruding from the bottom 24 of the body through a middle slot 30.

Figure 4:
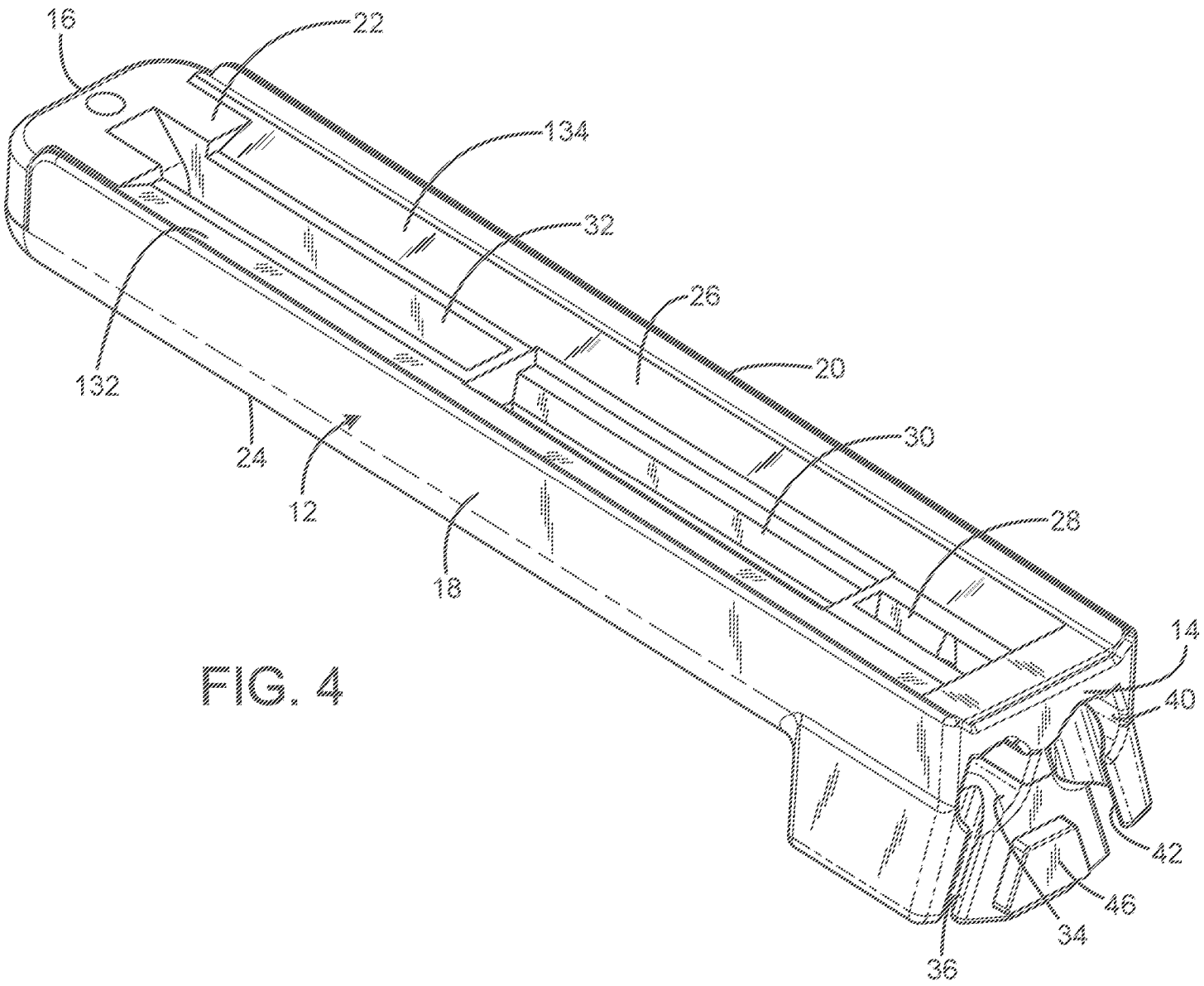
FIG. 4 is a top isometric view of the body of the bipod firearm support of FIG. 1.
Figure 5:
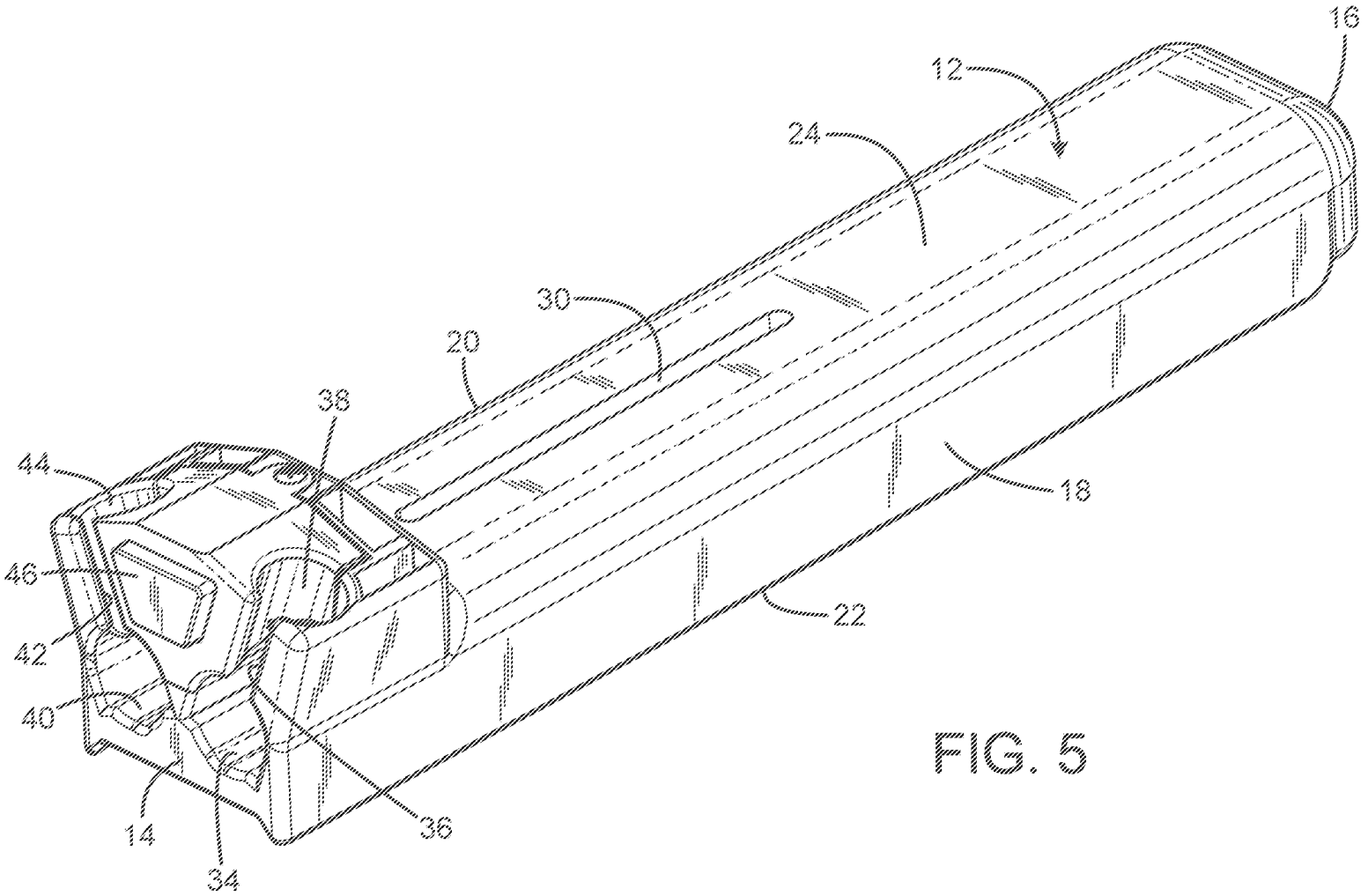
FIG. 5 is a bottom isometric view of the body of the bipod firearm support of FIG. 1.

In FIG. 4, the interior 26 of the body 12 is shown. The interior of the body defines a front slot 28, a middle slot 30, and a rear slot 32. As is shown in FIG. 5, only the middle slot penetrates the bottom 24 of the body. A right channel 132 and left channel 134 are defined on either side of the slots 28, 30, 32. The right and left channels are parallel to one another in the current embodiment and communicate with the right and left bores 34, 40, respectively. However, the channels can also be at an angle to one another in alternative embodiments.

Figure 6:
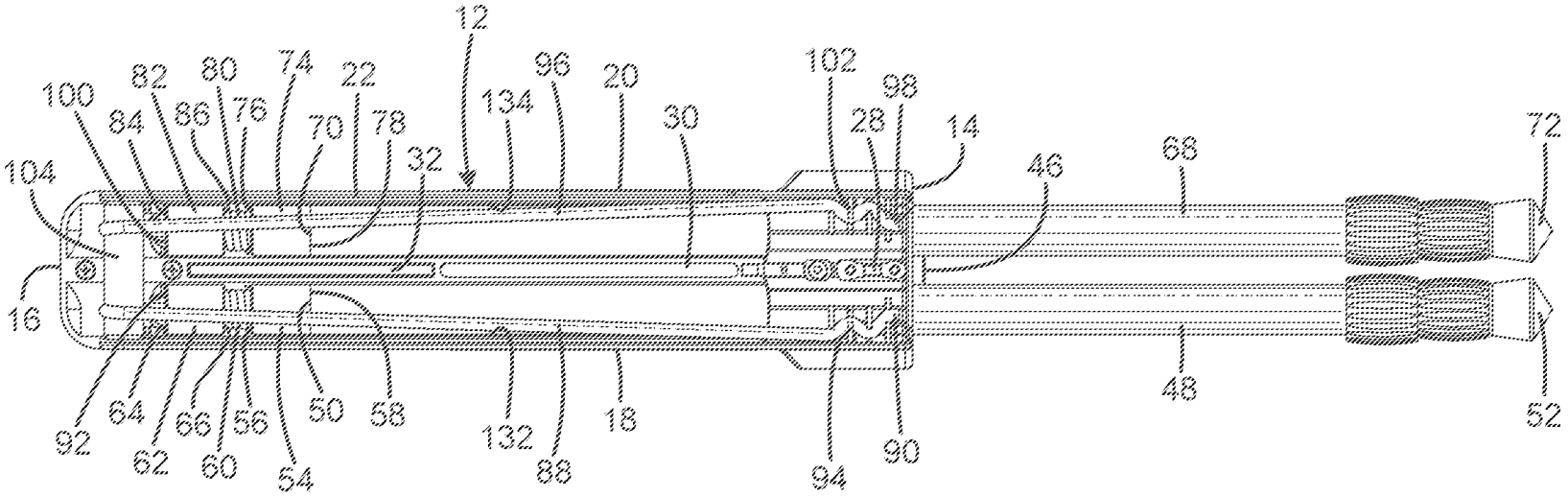
FIG. 6 is a top view of the body and support legs of the bipod firearm support of FIG. 1 with portions cutaway to illustrate the manner in which the opposed ends of the elastic cords are attached to the body and the support legs.
Figure 7:
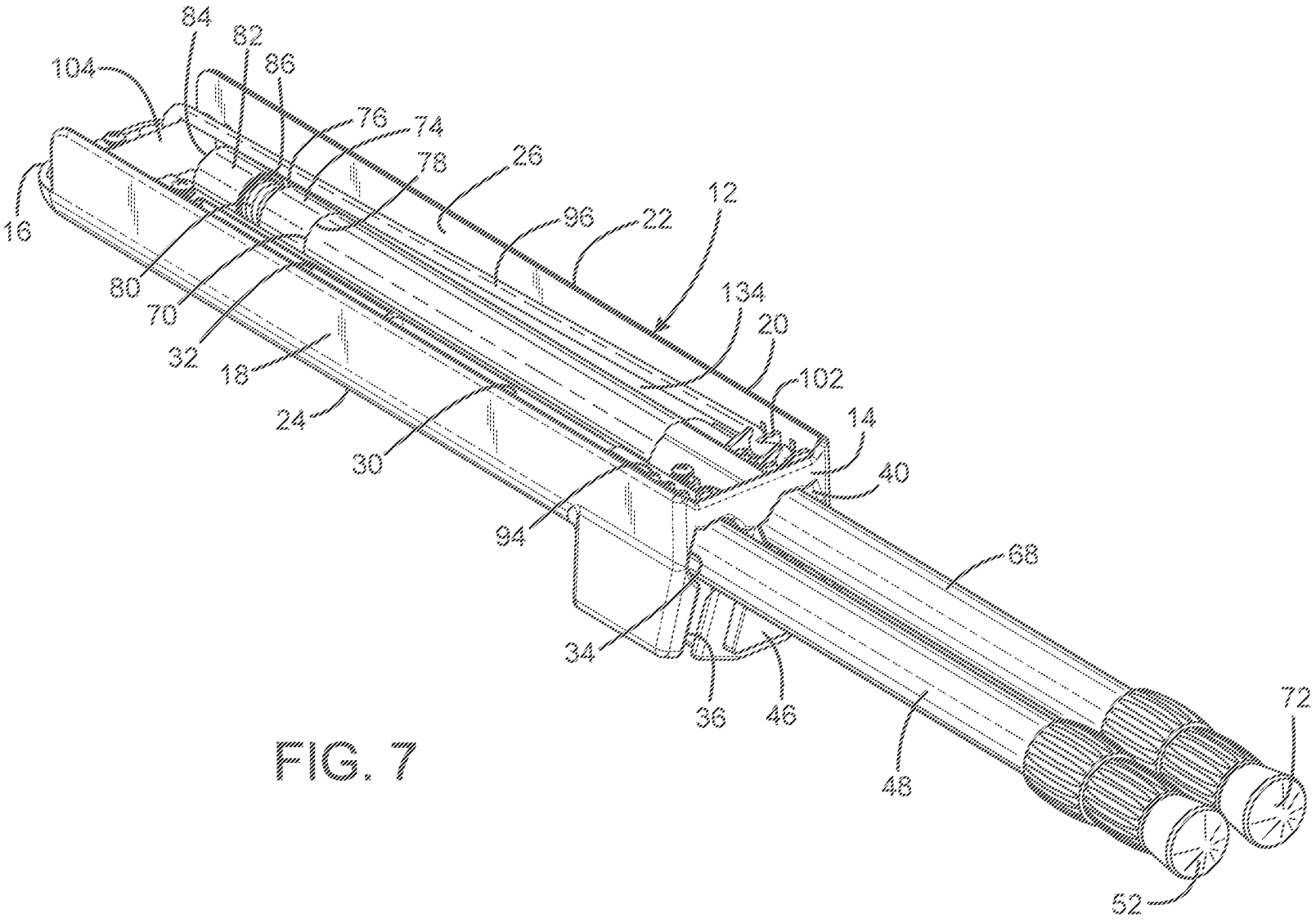
FIG. 7 is a top isometric view of the body and support legs of the bipod firearm support of FIG. 1 with portions cutaway to illustrate the manner in which the opposed ends of the elastic cords are attached to the body and the support legs.

In FIGS. 6 and 7, the interior 26 of the body 12 is shown with the right and left supporting legs 48, 68 in the stowed position. The right base segment 62, right coil spring 60, right end cap 54, and an upper portion of the right support leg are received within the right bore 34 and right channel 132. The left base segment 82, left coil spring 80, left end cap 74, and an upper portion of the left support leg are received within the left bore 40 and left channel 134. The top 64 of the right base segment receives one end 92 of right elastic cord 88. The opposed end 90 of the right elastic cord is attached to the front 14 of the body by right cord anchor 94. The top 84 of the left base segment receives one end 100 of left elastic cord 96. The opposed end 98 of the left elastic cord is attached to the front of the body by left cord anchor 102. Intermediate portions of the right and left elastic cords pass over a bearing 104 located at the rear 16 of the interior of the body. The right and left elastic cords double back over the bearing so the elastic cords can be stretched longer without being subjected to excessive strain that could result in failure. The right and left elastic cords serve to pull the left and right base segments into the left and right bores when the support legs are in the stowed position and into the left and right bore segments 38, 44 when the support legs are in the extended position. The elastic cords may be similar to those of U.S. Pat. No. 7,770,320 to Bartak), which is hereby incorporated by reference for all that it teaches therein.

Figure 8:
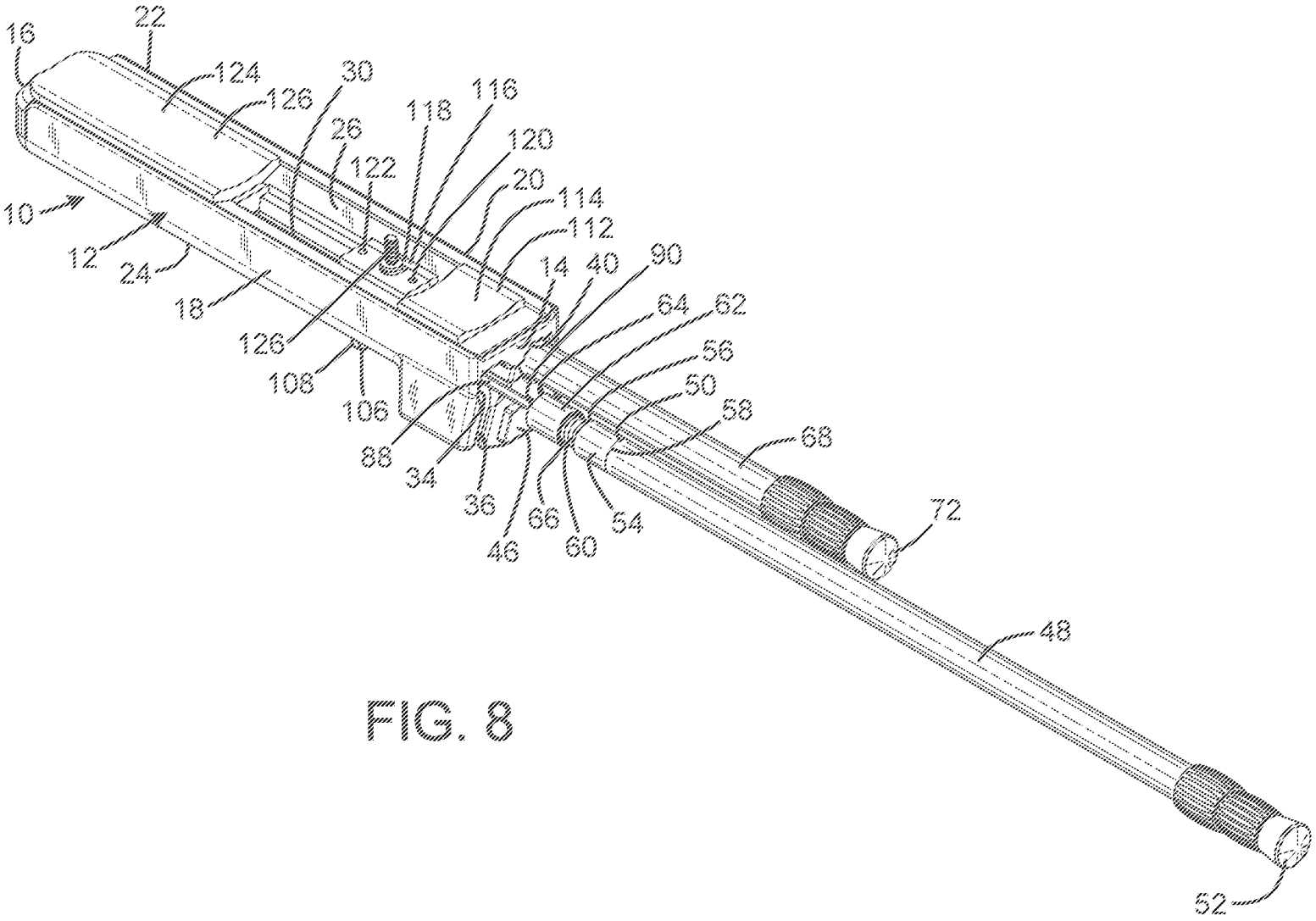
FIG. 8 is a top isometric view of the current embodiment of the bipod firearm support of FIG. 1 with one of the support legs completely removed from the corresponding bore.
Figure 9:
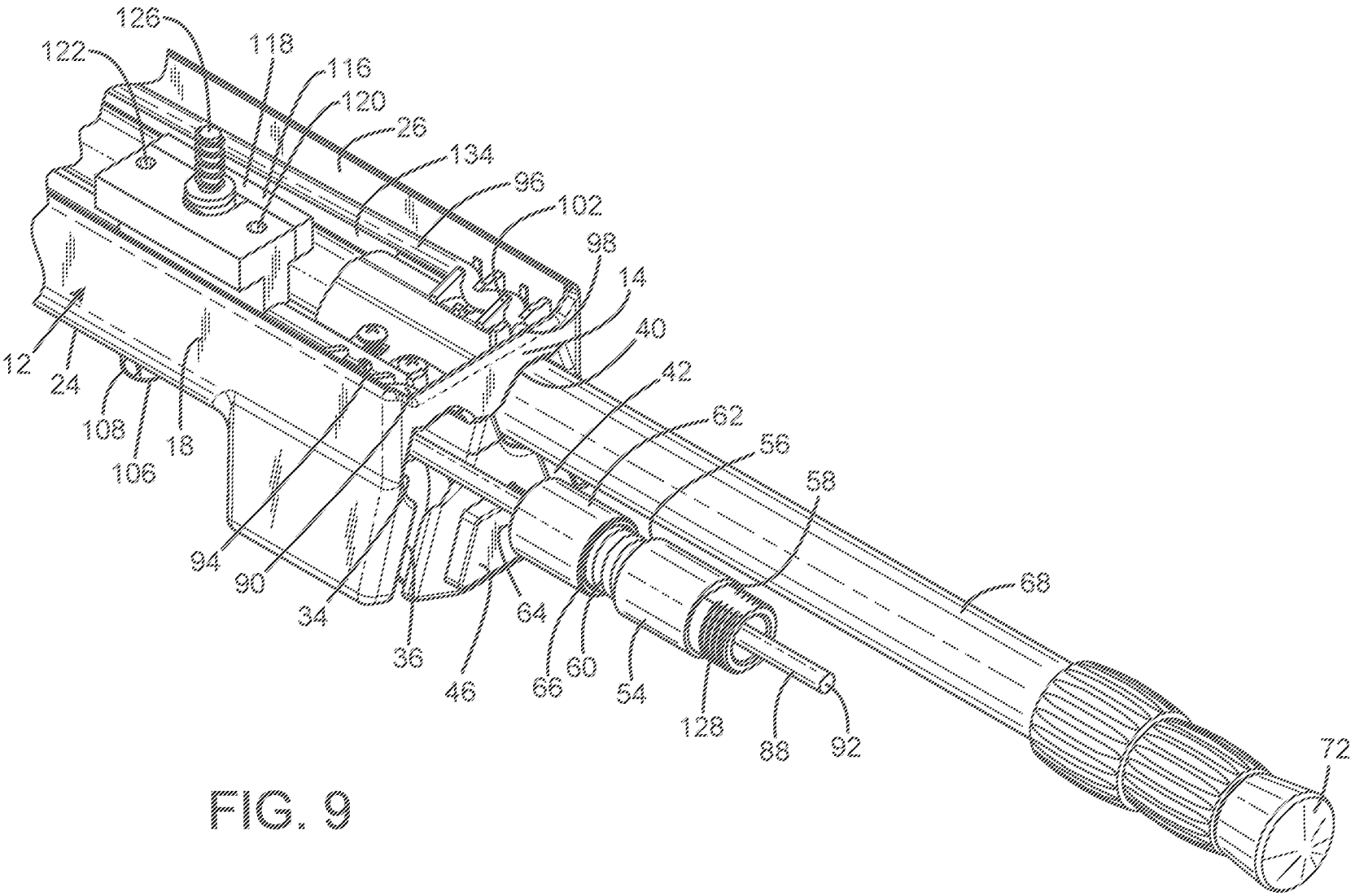
FIG. 9 is a partial enlarged top isometric view of the current embodiment of the bipod firearm support of FIG. 1 with portions cutaway to illustrate the manner in which the top of the support legs is threadedly connected to the bottom of the corresponding end cap.

In FIGS. 8 and 9, the right support leg 48 of the bipod firearm support 10 is shown in the process of being deployed from the stowed position into the extended position. More particularly, the shooter pulls the right support leg forward until the top 64 of the right base segment 62 is fully clear of the right bore 34. The shooter then pulls the right elastic cord 88 through the right slot 36, and then permits the right elastic cord to pull the right base segment 62 into the right bore segment 38. The identical procedure is repeated if desired to deploy the left support leg into the extended position. As can be appreciated from FIG. 9, the top 50 of the right support leg is attached to the bottom 58 of the right end 54 by epoxy or another suitable adhesive adhered to the undercut portion 128. The top 70 of the left support leg is similarly attached to the bottom 78 of the left end cap 74.

In the fully assembled state shown in FIG. 8, the top 22 of the body 12 of the bipod firearm support 10 has a front pad 112 attached to the interior 26 of the body utilizing front slot 28, a T block 116 attached to the interior of the body utilizing middle slot 30, and a rear pad 124 attached to the interior of the body utilizing rear slot 32. The top 114 of the forward pad and the top 126 of the rear pad are contoured to match the contour of the bottom 312 of the forend 310 of the stock 308 and prevent the bipod firearm support from marring the forend. The top 118 of the T block attaches to an existing or user-installed sling swivel screwed into the bottom of the forend of the stock via a threaded cross hole and a captured set screw 126 that runs through an existing threaded aperture 130 in the sling swivel. The T block also includes bores 120, 122 that receive the threaded portions 110 of the studs 106. The position of the T block and screw are longitudinally adjustable within the limits of travel imposed by the middle slot when the studs are loosened in order to enhance the compatibility of the bipod firearm support with stocks having a threaded aperture in different longitudinal positions on the forend. The studs then are tightened to secure the T block and screw in the desired position.

Figure 10:
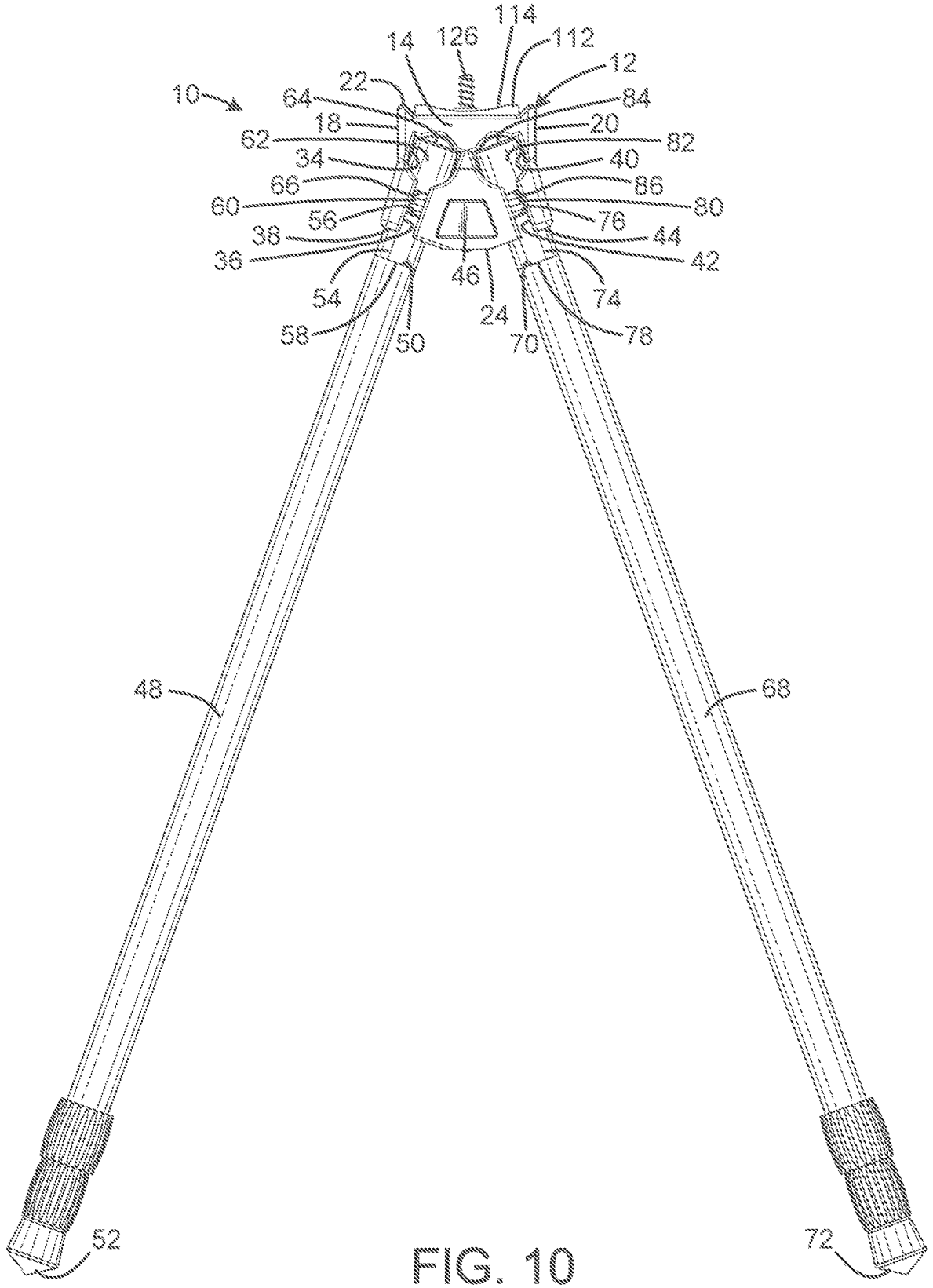
FIG. 10 is a front view of the current embodiment of the bipod firearm support of FIG. 1 illustrating the bipod firearm support being used in a level ground position.
Figure 11:
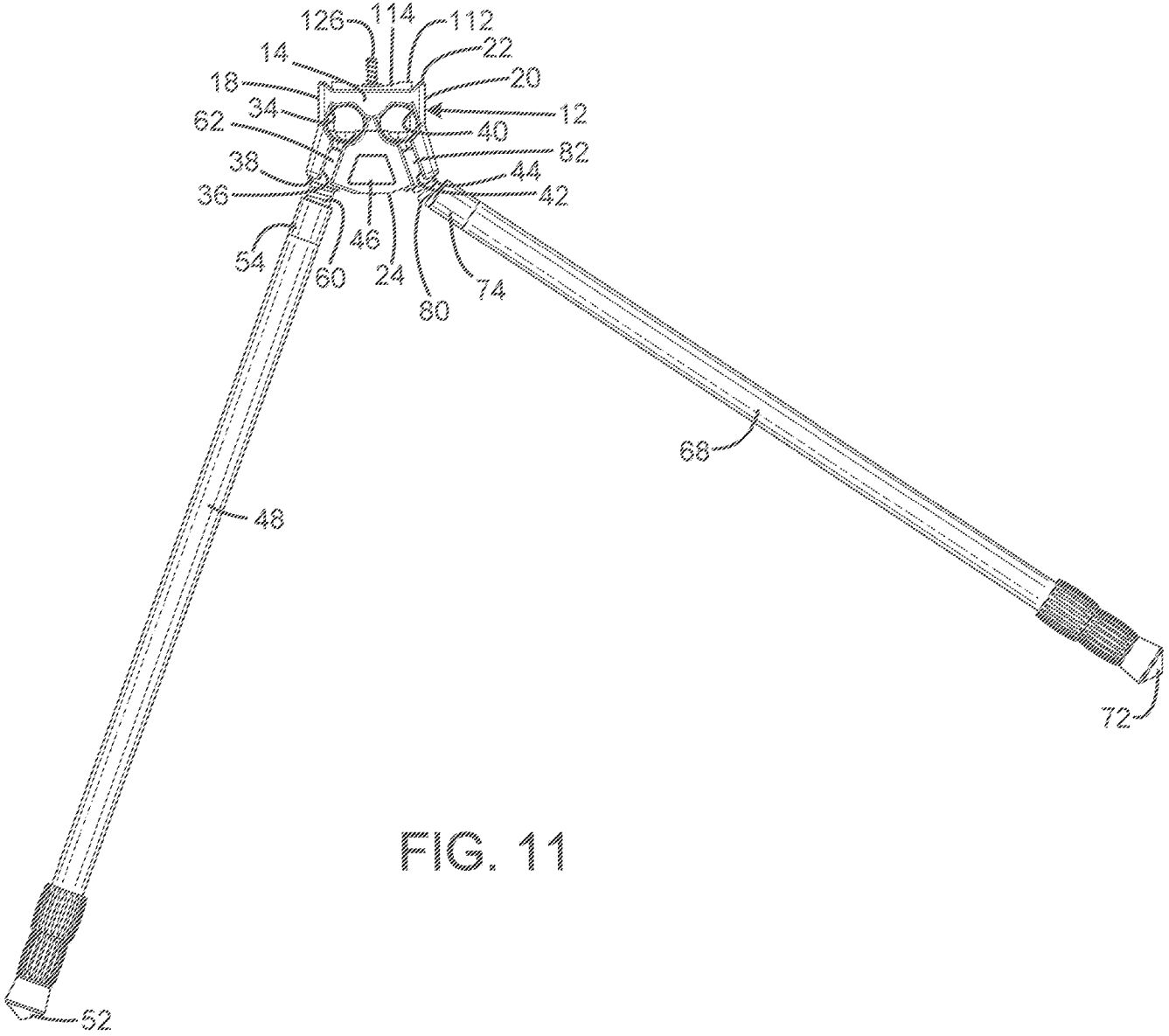
FIG. 11 is a front view of the current embodiment of the bipod firearm support of FIG. 1 illustrating the bipod firearm support being used in a side hill position.
Figure 12:
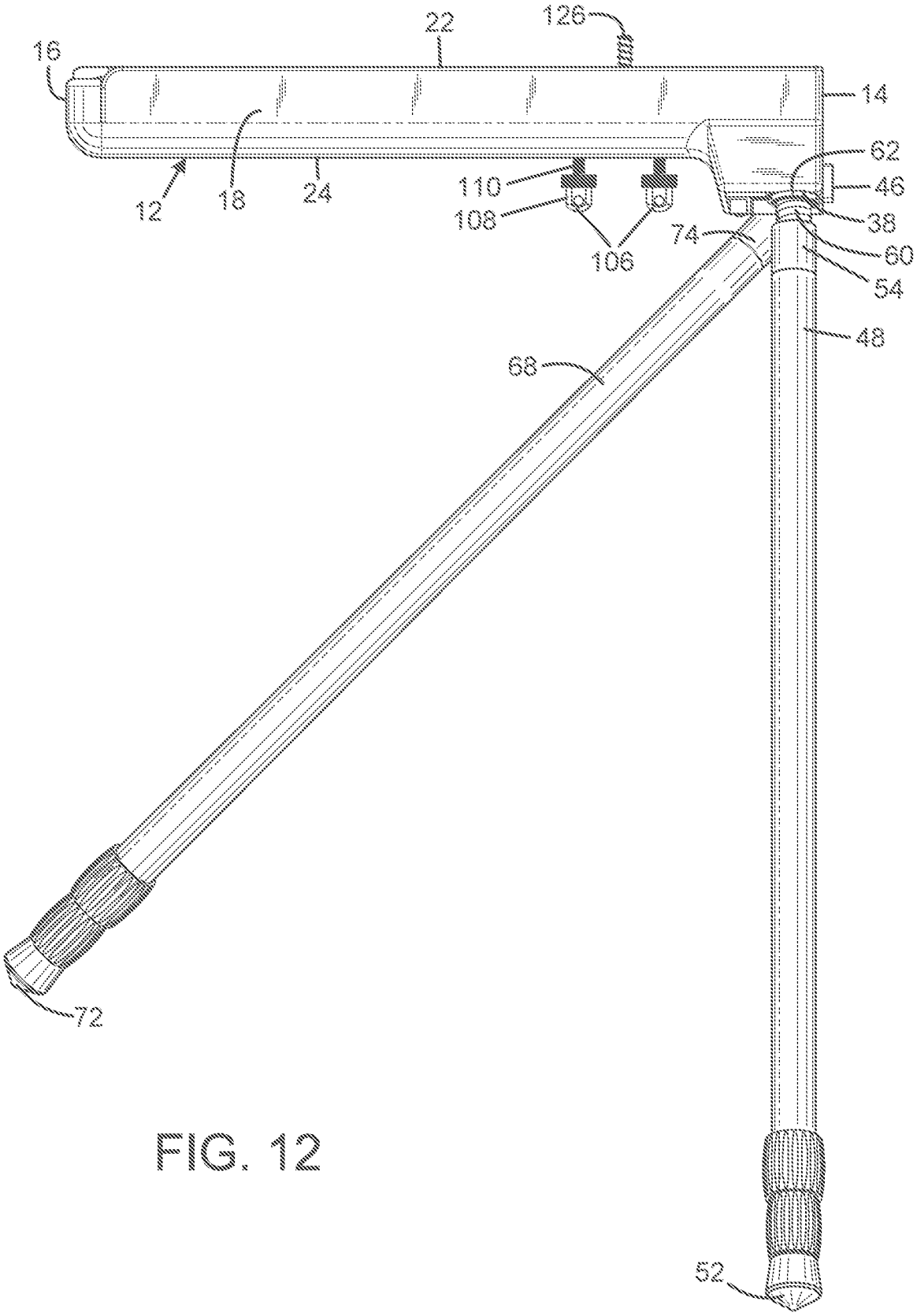
FIG. 12 is right side view of the current embodiment of the bipod firearm support of FIG. 1 illustrating the bipod firearm support being used in a different side hill position from that of FIG. 11.

FIGS. 10-12 illustrate the bipod firearm support 10 with the right and left support legs 48, 68 in the extended position adjusted for various types of terrain. The right and left support legs can assume two different axial positions within the bore segments 38, 44: a first flexible locked position with just a base segment 62, 82 of a support leg being closely received in a bore segment, and a second rigid unlocked position in which a support leg is inserted more deeply, and an end cap 54, 74 is also closely received in a bore segment. In FIG. 10, the right and left support legs are shown deployed in a rigid locked position suitable for level ground. The button 46 has been depressed to place the latches (not visible) internal to the right and left bore segments 38, 44 in the unlatched position. As a result, the right base segment 62, right coil spring 60, and the top 56 of the right end cap 54 are received within the right bore segment, and the left base segment 82, left coil spring 80, and the top 76 of left end cap 74 are received within the left bore segment. Therefore, the right and left coil springs are secured in axial alignment with respect to the base segments and end caps, and angular flexure of the right and left support legs 48, 68 is prevented.

In FIGS. 11 and 12, the right and left support legs 48, 68 are shown deployed in a flexible unlocked position suitable for use on the side of a hill. The button 46 has not been depressed, so the latches (not visible) internal to the right and left bore segments 38, 44 are in the latched position, which limits penetration of the support leg components into the bore segments. As a result, only the right base segment 62 is received within the right bore segment, and only the left base segment 82 is received within the left bore segment. Therefore, the right and left coil springs 60, 80 enable angular flexure of the right and left support legs in the presence of a deflecting force. In FIG. 11, the left support leg is flexed outwardly, and in FIG. 12, the left support leg is flexed rearwardly. In addition to the position shown in FIGS. 1 and 10-12, the right and left support legs can be used together like a monopod, can be flexed outwardly or pushed forward or pulled back to lower the muzzle of the supported firearm, can be lifted to raise the muzzle of the supported firearm, can be dragged over obstacles by the supported firearm while continuing to support the firearm, or can stand the firearm up at rest like a tripod.

Figure 13:
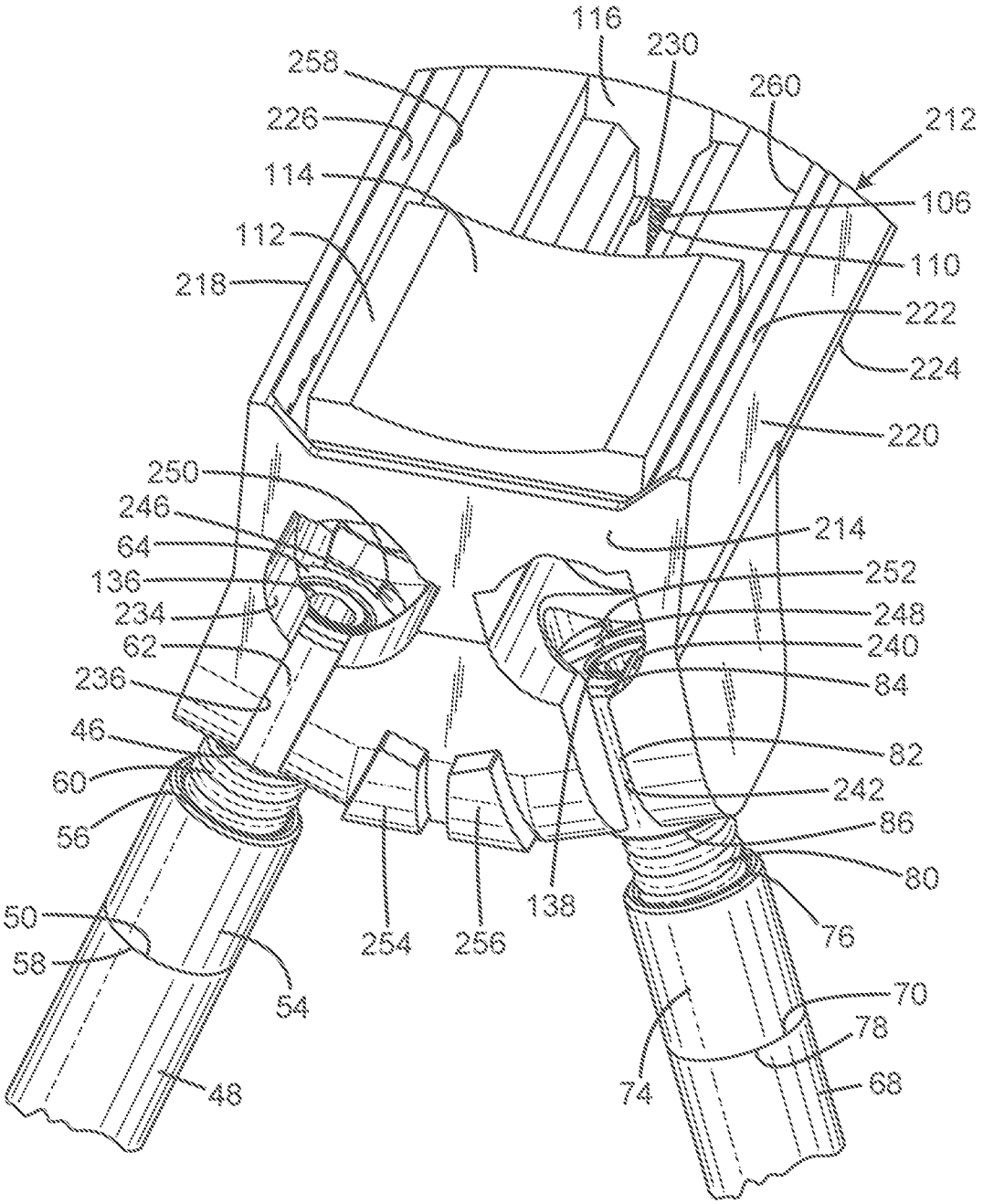
FIG. 13 is a partial enlarged front isometric view of an alternative embodiment of the body of the bipod firearm support of the current invention with the elastic cords removed.
Figure 14:
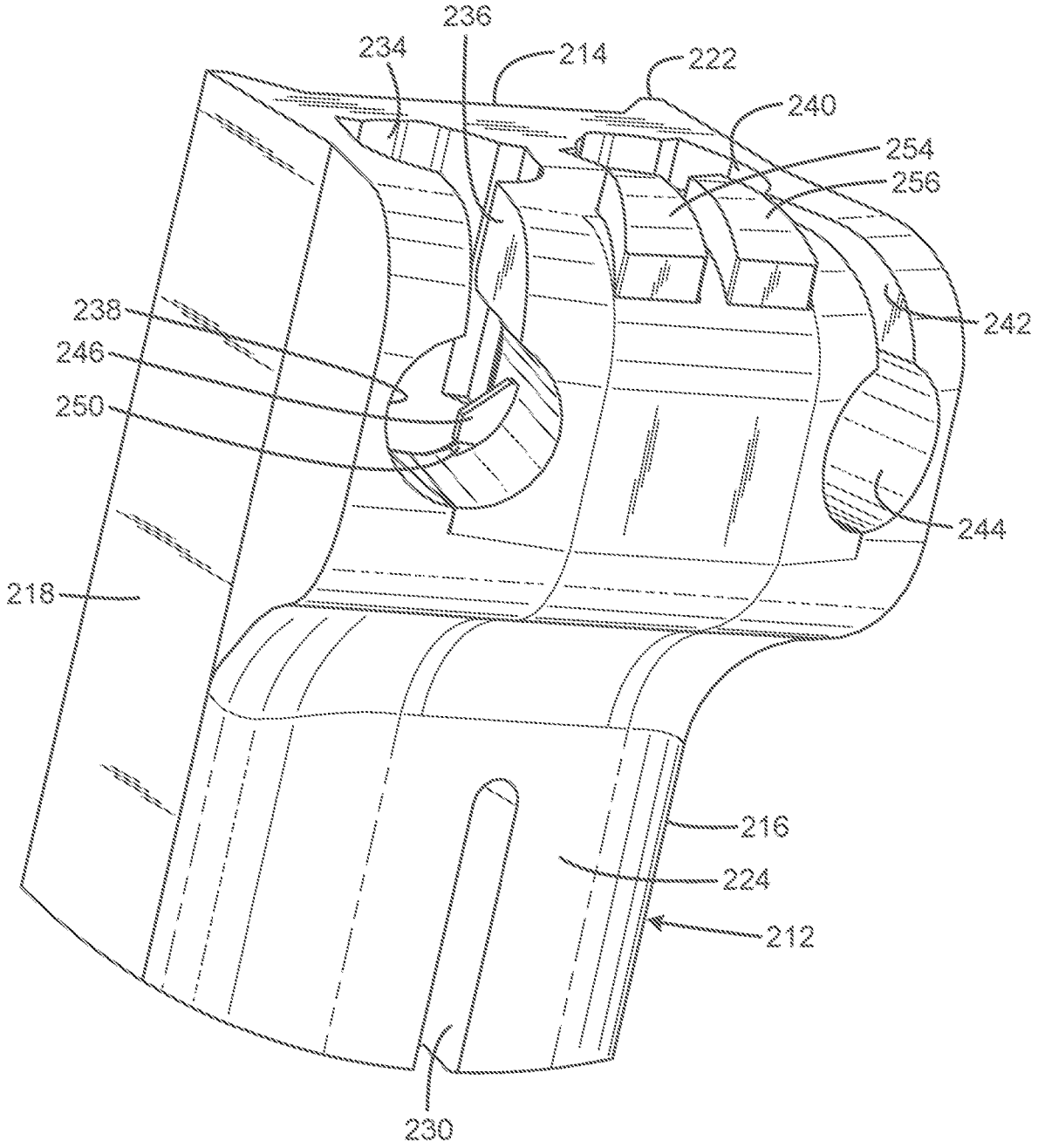
FIG. 14 is a partial enlarged bottom isometric view of the alternative embodiment of the body of the bipod firearm support of the current invention with the latches in the latched position.
Figure 15:
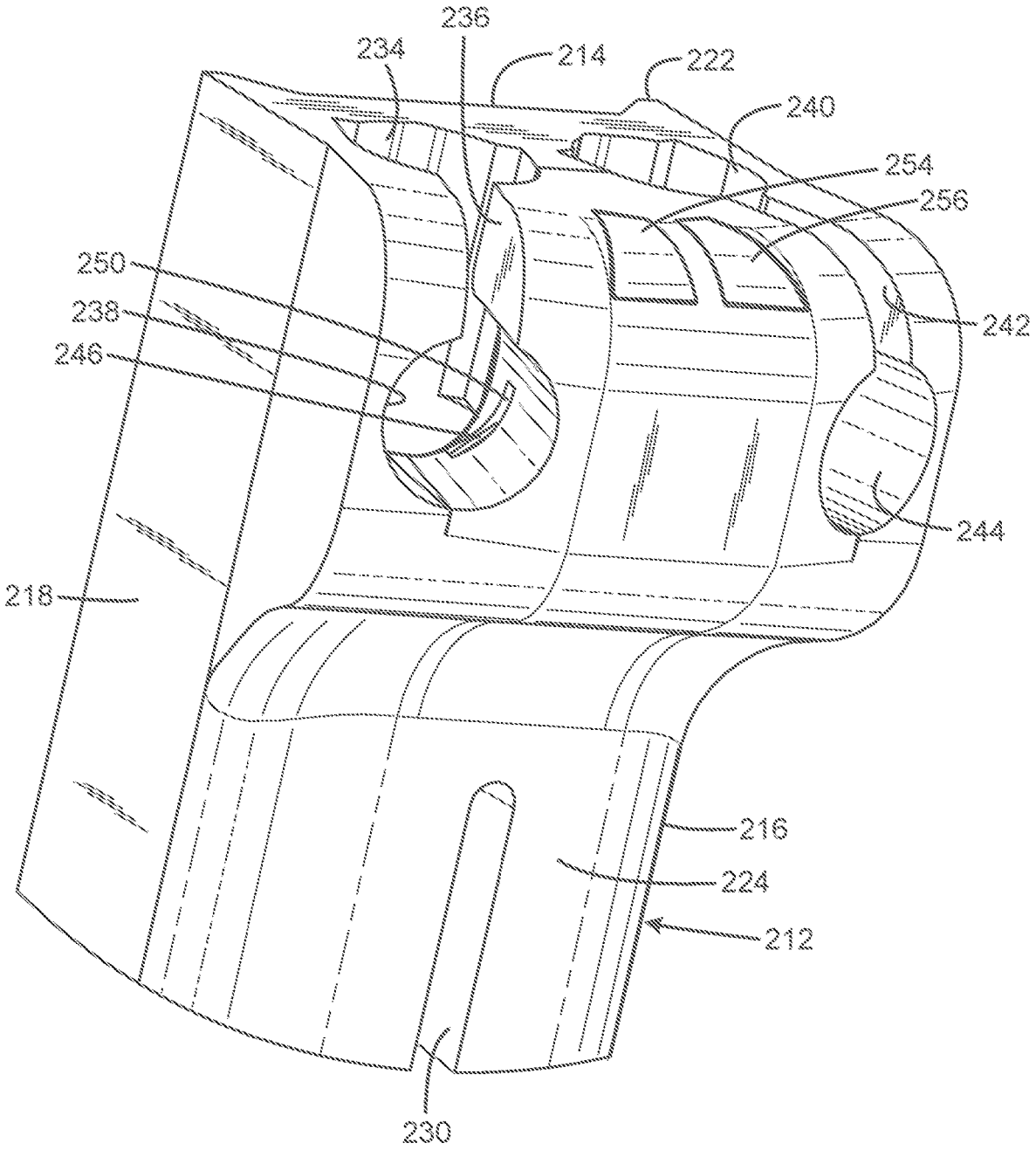
FIG. 15 is a partial enlarged bottom isometric view of the alternative embodiment of the body of the bipod firearm support of the current invention with the latches in the unlatched position.

FIGS. 13-15 illustrate an alternative embodiment of the body 212 the improved bipod firearm support of the present invention. More particularly, the body 212 uses the same internal right and left latches 246, 248 protruding from right and left latch slots 250, 252 as the body 12. FIGS. 13 and 14 show the right and left latches in the latched position with the right and left buttons 254, 256 not actuated, and FIG. 15 shows the right and left buttons actuated to place the right and left latches in the unlatched position. The primary difference between the body 212 and the body 12 is that the button 46 of the body 12, which latches and unlatches both the right and left latches simultaneously, is replaced by separate right and left buttons in the alternative embodiment. The separate right and left buttons enable individual control over the position of the right and left latches. This capability permits one support leg to be placed in the rigid locked condition and one support leg to be placed in the flexible unlocked condition if desired, which is not possible using body 12.

The body 212 has a front 214, rear (not visible), right side 218, left side 220, top 222, bottom 224, and interior 226. The front of the body defines a right bore 234 and a left bore 240 that are parallel to one another in the current embodiment. However, the right and left bore can also be at an angle to one another in alternative embodiments to accommodate alternative support leg designs and/or to avoid the bore of the attached firearm. A right bore segment 238 and a left bore segment 244 are in communication with, perpendicular to, and angularly offset with respect to their respective bores in the current embodiment. However, the bore segments can also be at angles other than 90° to their respective bores in alternative embodiments. A right slot 236 and a left slot 242 are in communication with their respective bores and bore segments. The interior of the body defines a front slot (not visible), a middle slot 230, a rear slot (not visible), right and left channels 258, 260, a bearing (not visible), and right and left anchors (not visible). The body 212 also has changes to the contours relative to the body 12 to improve moldability in the current embodiment. All of the other components of the bipod firearm support 10 are suitable for use with the body 212 to assemble a complete bipod firearm support. The right and left elastic cords 88, 96 have been omitted so central bores 136, 138 in the tops 64, 84 of the right and left base segment 62, 82 that receive ends 92, 100 of the right and left elastic cords are visible.

In the current embodiment, the length of the right and left elastic cords exposed from the right and left base segments is 11⅜ inch. The total length of the collapsed support legs is 17⅝ inch including the flexible member for the longer length version and 13½ inch including the flexible member for the shorter length version. The combined length of the bores and channels is 9½ inch.

Turning back to FIG. 11. As noted, the left 60 and right 80 coil springs enable angular flexure of the right and left support legs when the coil springs 60 and 80 are located outside of the bore segment. The left 60 and right 80 coil springs have several advantages. As noted, they allow each leg to flex and pivot at the spring. In one embodiment, and as depicted in FIG. 11, the coil springs allow each leg to flex independently. Because the legs can flex, this allows the bipod to be mounted on uneven terrain. If for example, a rock was sticking out below the right leg 68, then the coil spring allows the right leg 68 to flex inwardly or outwardly as necessary to accommodate the rock. Without the spring coil the legs would be rigidly fixed at the specified location.

The spring coil can comprise any spring known in the art. The diameter, length, and resiliency of the spring coil can be adjusted as necessary. For example, in some embodiments a longer spring coil allow for increased flexing ability.

While one embodiment of a spring coil has been disclosed in reference to a bipod wherein the legs partially retract into the bipod body, this is for illustrative purposes only and should not be deemed limiting. Furthermore, while one embodiment of a spring coil being located on the end of the legs has been demonstrated, this is likewise for illustrative purposes only and should not be deemed limiting. Finally, while one embodiment wherein the legs are tethered via elastic cords 88, 96, this is for illustrative purposes and should not be deemed limiting.

Figure 16:
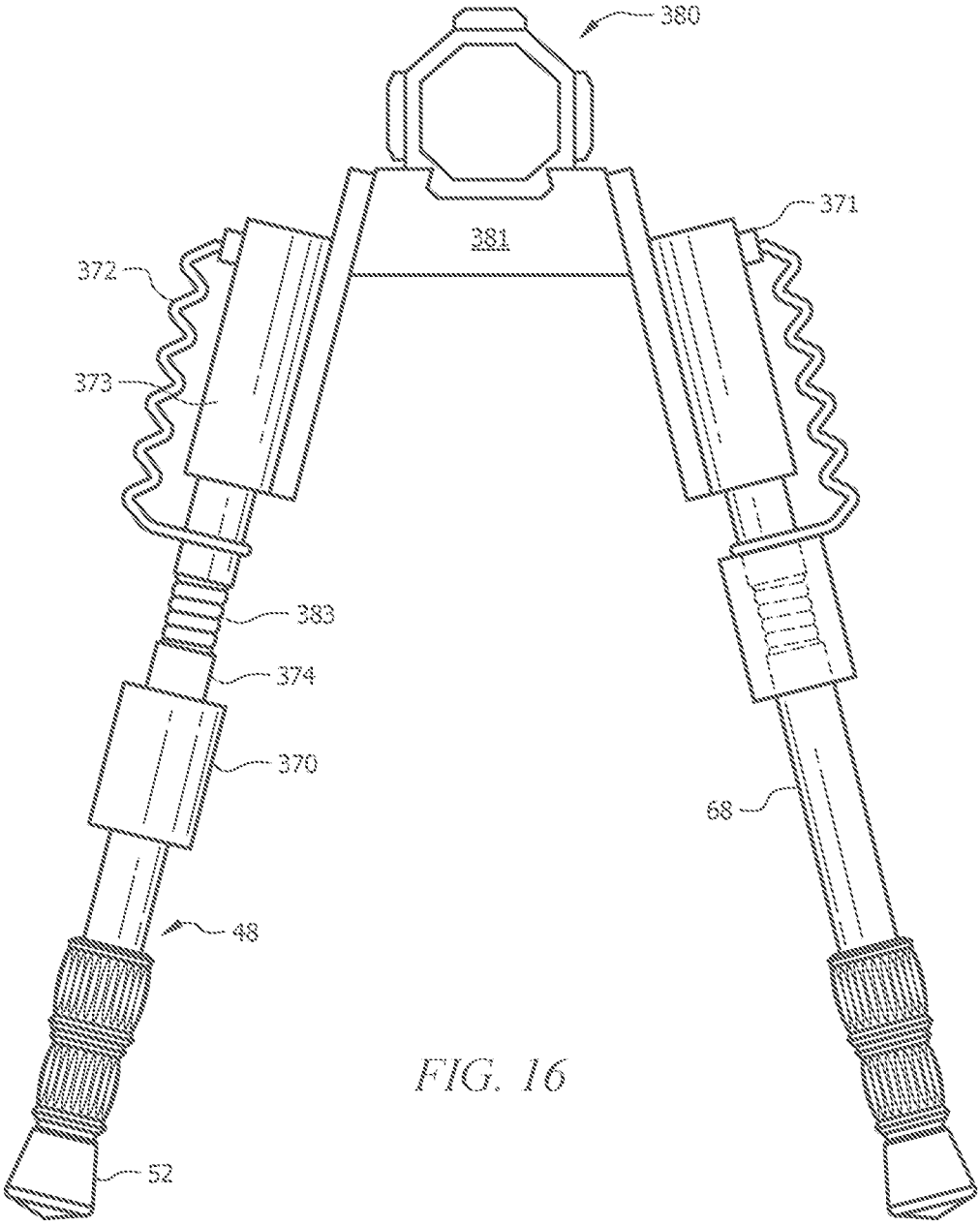
FIG. 16 is a front view of a bipod with a fixed point rotation in one embodiment.

FIG. 16 is a front view of a bipod with a fixed point rotation in one embodiment. In the embodiment depicted, rather than the legs 48, 68 be hinged via an elastic cord 88, the legs 48, 68 pivot about a fixed hinge point 371. The legs 48, 68 can rotate about the hinge point 371 to be moved from a stored, retracted position, to an extended position. A fixed hinged point is a hinged point which does not move. Thus, rather than the elastic cords 88, 96, previously discussed, a fixed hinged point is static and stationary. A fixed hinged point, therefore, only allows the legs to rotate about the hinge point.

The bipod of FIG. 16 can be attached to a bipod body (shown as reference numeral 12 in FIG. 1) as previously addressed. In other embodiments, however, the bipod does not comprise a central body connecting the two legs. Instead, in one such embodiment, each leg is independently attached and/or coupled to a firearm. In still other embodiments the legs are coupled to one another but not through a central bipod body which houses the legs when they are in a retracted position. As discussed herein, in one embodiment the leg or legs are attached to the firearm without the need for a central body which houses the leg or legs. Instead, the leg or legs are visible when in both the retracted and extended positon. In one embodiment a majority of the legs, as measured by the length, are not housed in a body during either the retracted or extended orientation. Thus, in one embodiment the majority of the legs are visible to a user in both a retracted or extended orientation. This is contrasted with, for example, FIG. 9 whereby a majority of the legs are stored within the housing 12.

The elimination of a central body which houses the legs when in the retracted position is a benefit in certain embodiments. One advantage is that, because the central body is not housing legs, it can be comparatively smaller. This reduces weight as well as manufacturing cost and materials. Further, because a coupler is used to couple the leg or legs to the firearm as opposed to a comparatively larger central body, less real estate is required to couple the legs to the firearm. Again, compared to the central body 12 of FIG. 1, a comparatively smaller coupler can be utilized to couple the legs. This frees up additional real estate for other accessories.

Returning back to FIG. 16, the bipod, as depicted, further comprises a biasing mechanism 372 which biases the legs to one or more positions, i.e., either extended or retracted. As depicted the biasing mechanism 372 comprises springs but this is for illustrative purposes only and should not be deemed limiting. Any object, including coils, springs, memory materials, etc. can be used to provide the bias. In other embodiments, there is no such biasing mechanism 372. The biasing mechanism 372, in one embodiment, biases the legs 48, 68 to either a retracted position, an extended position, or both.

As depicted the legs 48, 68 comprise an upstream end 373 and a downstream end 374. An upstream end 373 refers to a portion of the leg which is closer to the coupler 381, or the hinge point 371 where there is no body, whereas a downstream end refers to a portion which is further away from the bipod body, or hinge point 371 where there is no such body. In one embodiment, and as depicted, the upstream end 373 is separated from the downstream end 374 via a flexible joint 383.

A flexible joint, as used herein, refers to a coupling which allows the leg to flex and move relative to the flexible joint.

In practice, this allows a user to obtain a desired angle and shooting position. The flexing also allows the system to accommodate varying ground elevations, imperfections do to rocks, etc.

The flexible joint 383 can comprise virtually any joint known in the art which allows for such flexing. In one embodiment the flexible joint comprises a coil spring 60, 80, such as the one previously described. The coil spring 60, 80 can function as noted above. While the figures depict a coil, this is for illustrative purposes only and should not be deemed limiting.

Other than coils, the flexible joint can also comprise, for example, a ball and socket joint. In such an embodiment one end is a ball whereas the other adjoining end is a socket, and the ball is allowed to rotate within the socket. The flexible joint can also comprise a rod/piston coupling whereby a rod is allowed to flex relative to an outer piston. In one embodiment hydraulic fluid can be utilized to soften and control the flexing.

In one embodiment the flexible joint allows flexing in more than one dimension. For example, considering a spring, the spring allows flexing in all three dimensions. Thus, in one embodiment the flexible joint allows flexing in all three dimensions. As noted, this helps the user attain a desired angle, position, etc.

While the flexible joint 383 is depicted as being in the relative middle of the leg, this is for illustrative purposes only. The flexible joint can be located on the extreme ends of the legs, or it can be located along the length of the legs as depicted in FIG. 16. Having a flexible joint 383 on the upper end of the leg is an advantage in some embodiments because the lower end is increased, and accordingly often a larger flexing angle can be achieved. As depicted, the leg 48, 68 can pivot and angularly flex at the location of each flexible joint.

Also depicted in FIG. 16 is a lock 370. A lock 370 is a device which when locked prevents flexing of the flexible joint 383. As depicted the left leg 48 has the 370 located in an unlocked position. The leg 48 is allowed to flex and bend at the location of the flexible joint 383. Put differently, the lock 370 does not prevent the flexible joint from flexing. However, the right leg 68 has the lock 370 in a locked position. In such an embodiment the lock 370 prevents the flexible joint from flexing. This converts the leg to a rigid position because the flexible joint is prevented from flexing. As depicted, the lock 370 surrounds the flexible joint 370 in such a way that the flexibility of the flexible joint is prevented. In one embodiment the lock 370 has an inner diameter which is greater than the outer diameter of the flexible joint 383 but the tolerance is tight enough that flexing movement is restrained by the inner diameter of the lock 370. When movement of the flexible joint 383 is prevented or restrained, the leg is in the rigid position.

The lock 370 can be locked in a variety of ways. In one embodiment the lock 370 is simply raised or lowered into its desired location and then set via a set pin, locking pin, or other such device. In still other embodiments the lock 370 comprises internal threads which matches the threading of the upstream end 373 and/or the downstream end 374 to allow the lock 370 to be raised and lowered by rotating the lock 370. In this fashion, in one embodiment, the flexible joint 383 can be located along the length of the leg 48, 68 as opposed to the extreme ends. Accordingly, this allows the flexible joint 383 to be placed at any desired location. In one embodiment the flexible joint 383 is closed to the coupler 381, as previously discussed. As noted, in another embodiment the flexible joint 383 is located approximately in the middle of the leg 48, 68. In still other embodiments the flexible joint 383 is located closer to the extreme downstream end of the leg.

The lock 370 is depicted as being stored below the flexible joint 383, but this is for illustrative purposes only and should not be deemed limiting. In other embodiments the lock 370 can be stored above the flexible joint 383 as well.

As can be seen from the embodiment depicted in FIG. 16, the benefits and advantages of the flexible joint 383 are not limited to embodiments utilizing an elastic cord, nor are they limited to embodiments wherein the legs must be pulled within a bore of the bipod body. In the embodiment depicted in FIG. 16, for example, the legs can simply pivot to be pulled adjacent to the bipod body or adjacent to the firearm body; there is not requirement that the legs be located within the bipod body.

Also depicted in FIG. 16 are the feet 52. The feet can comprise virtually any type of feet. In one embodiment the feet are rubber to allow for increased gripping.

It should be noted that while FIG. 16 shows the legs being pivotally attached to the coupler 381 so that it pivots inwardly and outwardly (in and out of the page), in other embodiments the legs may be coupled to swing inwardly and outwardly relative to one another. Thus, the left leg can pivot toward and away from the right leg. In one embodiment the legs can still pivot from a retracted to extend position as described, but the legs can additionally pivot inwardly and outwardly left and right as viewable on FIG. 16. One benefit for this is that the legs can be shipped and stored adjacent to one another, resulting in a tighter and smaller package. In one embodiment the legs can be locked in the set angled position. A release and lock pin can also be utilized in such an embodiment.

Figure 17:
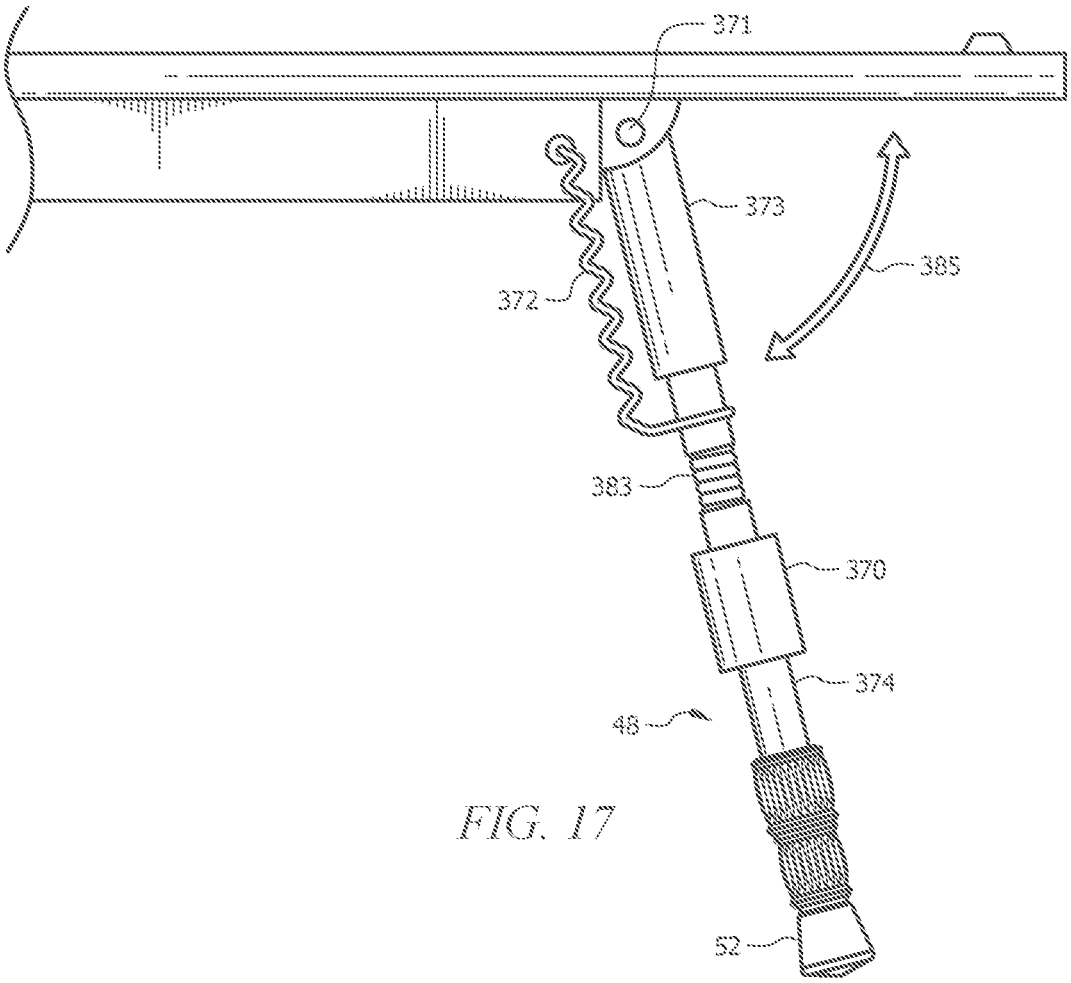
FIG. 17 is a side view of a bipod with a fixed point rotation in one embodiment.

FIG. 17 is a side view of a bipod with a fixed point rotation in one embodiment. As depicted, the leg 48 can pivot about pivot point 371 from a retracted position adjacent to the firearm barrel, for example, to an extended position away from the firearm barrel, as depicted. The angle difference 385 between the extended and retracted positions can vary. In one embodiment the angle 385 is greater than 20 degrees. In another embodiment the angle 385 is greater than 30 degrees. The leg 48 can be pulled downward into an extended positon when the user desires to use the bipod. When finished, the user can push the leg 48 back into the retracted position. A user might want to store the leg 48 in the retracted position when the leg 48 is not in use such as when the user decides to shoot or aim without the benefit of the shooting leg or legs. Additionally, the leg 48 may be in the retracted position when the firearm is being transported.

As depicted the bipod comprises a biasing mechanism 372, discussed above. The biasing mechanism 372 can cause the leg 48 to assume either the retracted or extended position. In one embodiment the user need simply press a button, switch, or other such mechanism which will allow the biasing mechanism to automatically pull the leg 48 into the retracted position.

Figure 18:
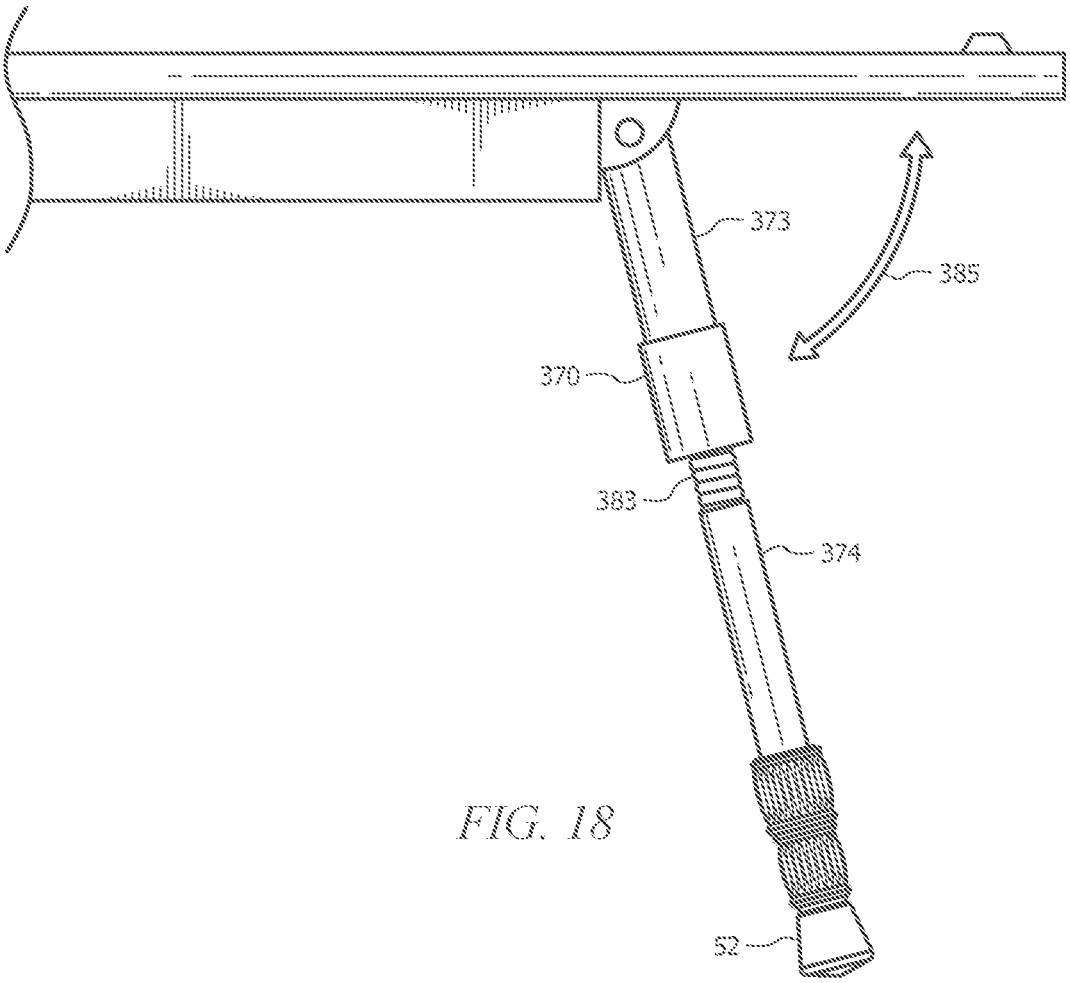
FIG. 18 is a side view of a bipod with a fixed point rotation in one embodiment.

FIG. 18 is a side view of a bipod with a fixed point rotation in one embodiment. As depicted the bipod does not have a biasing mechanism. Instead, the user will manually pull and push the legs as necessary to reach the extended or retracted positions. In one embodiment the bipod will comprise a locking device which will lock the legs in a desired location. In one such embodiment the user can lock the bipod in either the extended or the retracted position. In another embodiment the user can lock the legs, or one of the legs, in a position somewhere between the retracted and fully extended position. Thus, if the user does not want the leg to extend to its full position, the leg can be locked in its desired location. The locking mechanism can comprise any mechanism known in the art to secure a rotating leg in a desired location and prevent further pivoting.

The embodiment depicted in FIG. 18 comprises a lock 370 located above, and upstream, of the flexible joint 383. In this embodiment, the lock 370 can be adjusted downward to lock the flexible joint 383 and prevent angular movement about the flexible joint 383.

Figure 19:
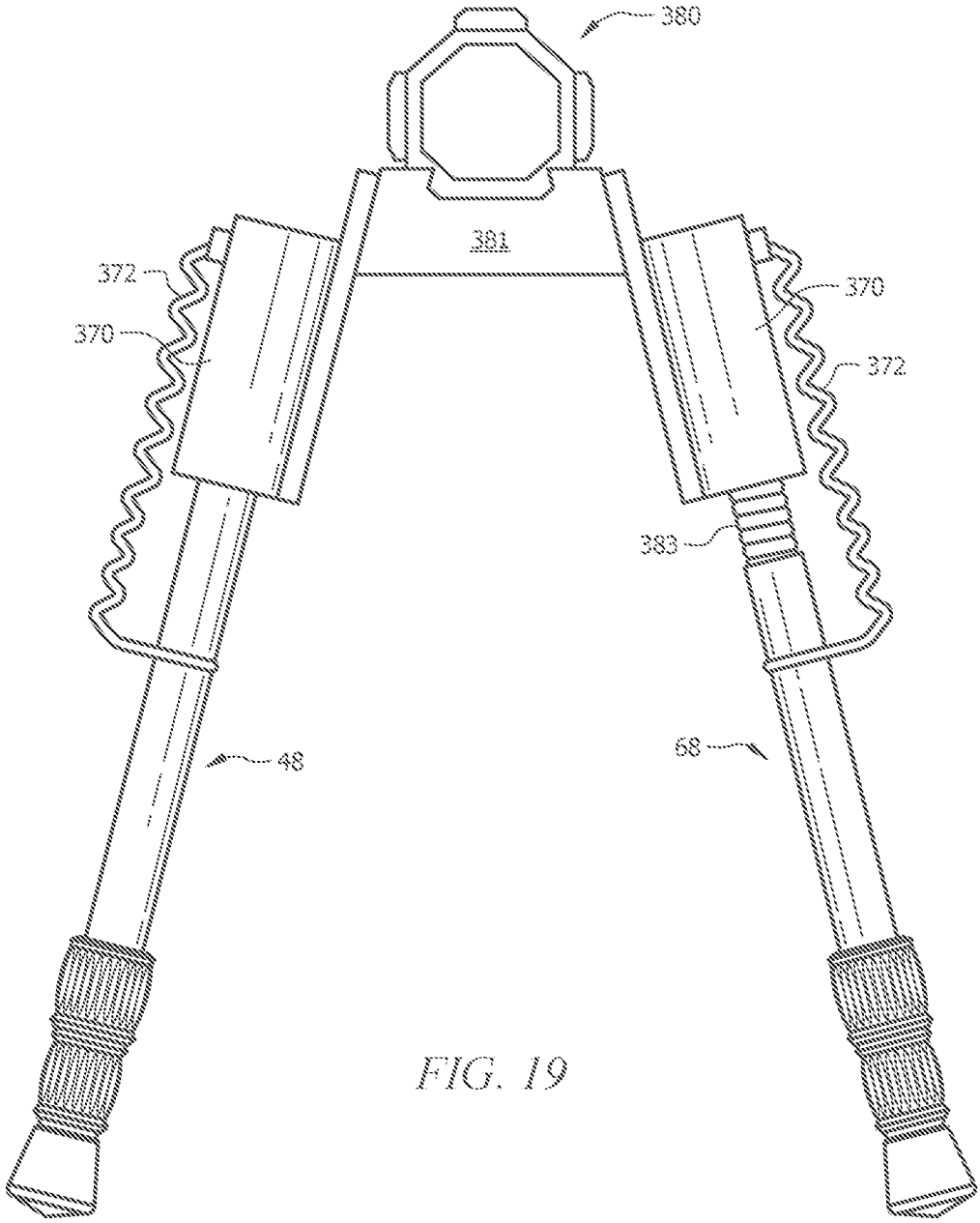
FIG. 19 is a front view of a bipod in one embodiment.

FIG. 19 is a front view of a bipod in one embodiment. In the embodiment depicted the lock 370 is coupled to the hinge. In one embodiment the lock 370 is attached to the hinge section. The lock 370 can be adjusted as necessary to control and lock and unlock the flexible joint 383. The lock 370 can be a piece integrally made with other pieces, or it can be a separate piece or sleeve.

There are several advantages of the lock 370. First, it allows two separate embodiments to be utilized: one in which the flexible joint 383 is unlocked and the legs can move and bend relative to the flexible joint 383, and one in which the flexible joint 383 is locked and prevents bending about the flexible joint 383. Second, in one embodiment the lock 370, because in some embodiments it rigidly couples the upstream end with the downstream end, prevents any movement about the flexible joint 383. This is contrasted with embodiments wherein only an upstream end, for example, is held secure because the legs can still experience some bending. By rigidly coupling the upstream end and the downstream end, in some embodiments, all movement is eliminated.

While the lock 370 has been described as a cover or housing which surrounds the flexible joint 383 to prevent flexing, this is for illustrative purposes only and should not be deemed limiting. In other embodiments, for example, the lock 370 comprises an internal lock which prevents flexing of the flexible joint 383. As but one example, in one embodiment the lock 370 comprises a rod and the flexible joint 383 comprises a coil or spring. In such an embodiment the rod is inserted into and through the coil. In such a way the spring is prevented from flexing by the presence of the rod. Thus, rather than restraining flexing by an outside force, flexing is restrained by an internal force. In such embodiments the movement of the rod, or other element, controls whether the flexible joint 383 is locked or unlocked.

Figure 20:
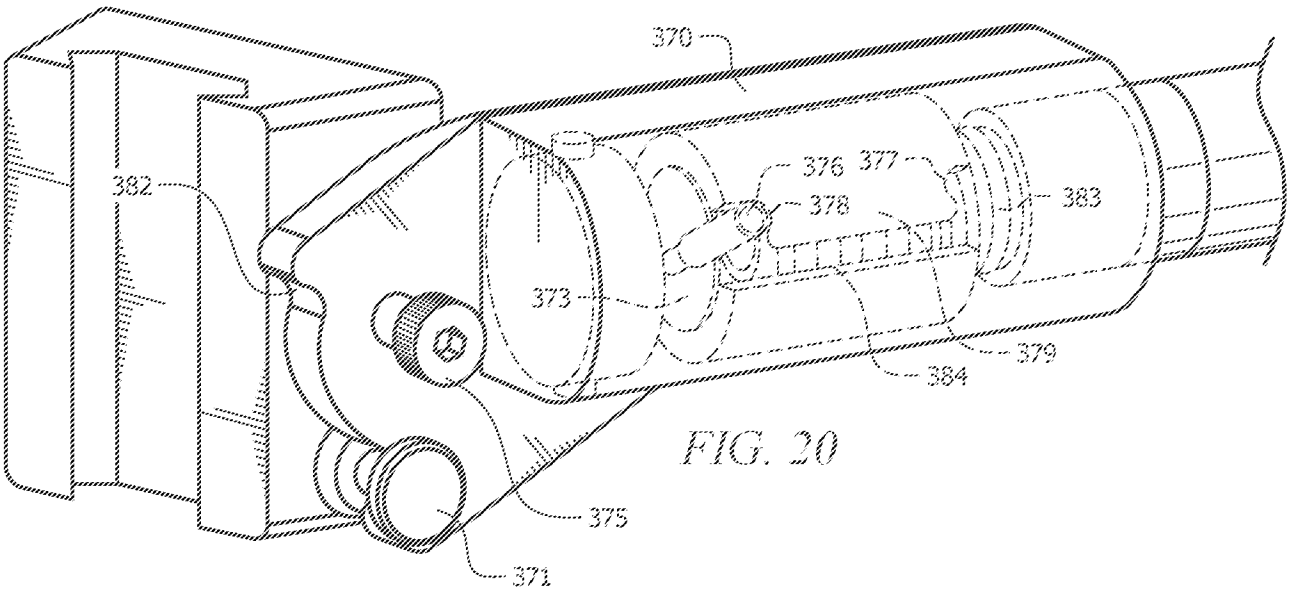
FIG. 20 is a perspective view of a hinged leg in one embodiment.
Figure 21:
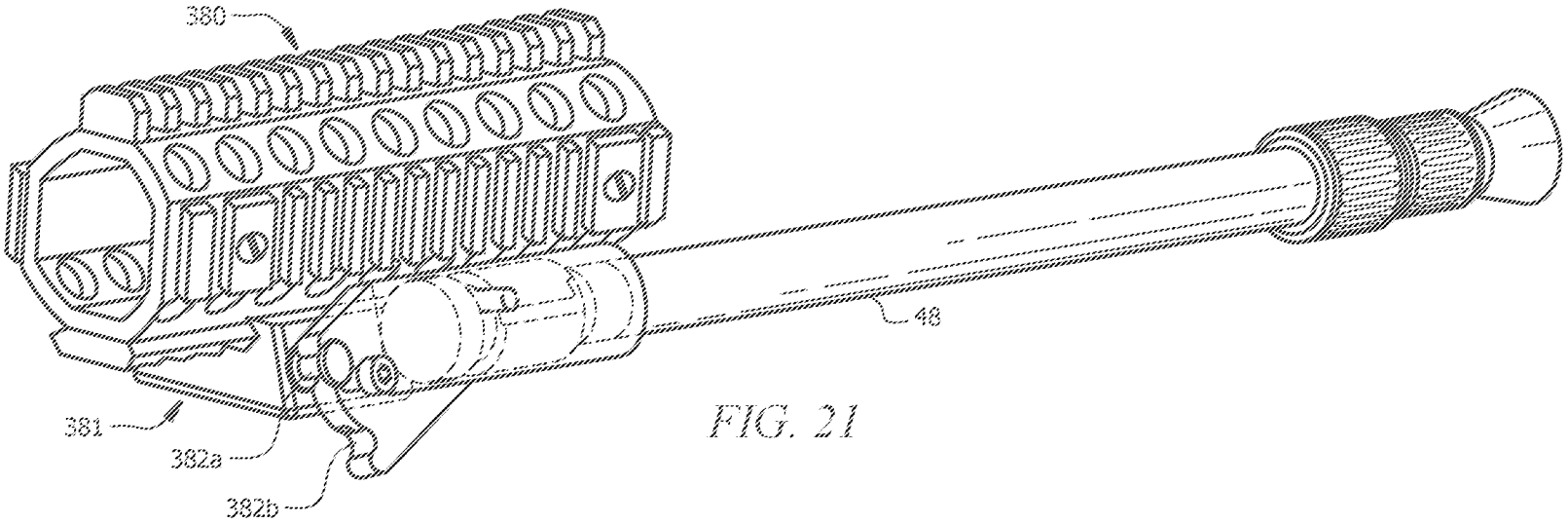
FIG. 21 is a perspective view of a hinged leg in a retracted position in one embodiment.
Figure 22:
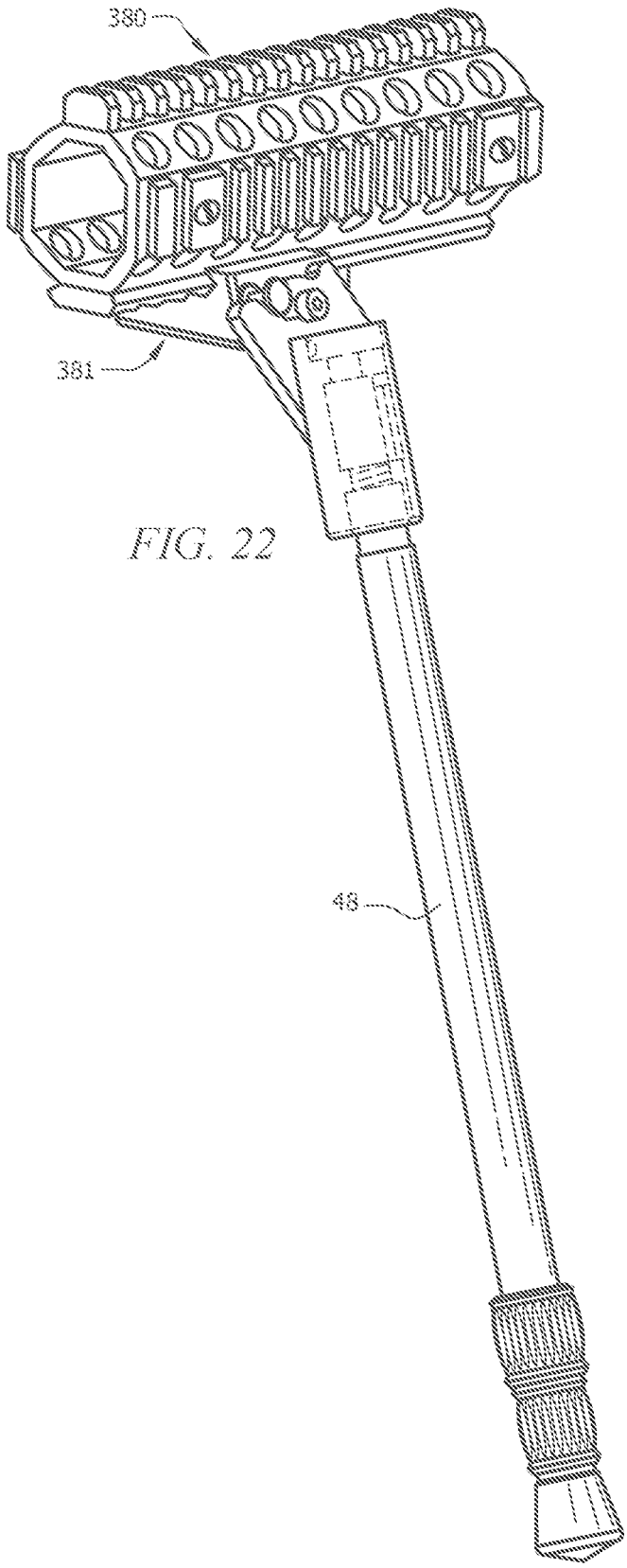
FIG. 22 is a perspective view of a hinged leg in an extended position in one embodiment.

Turning now to FIGS. 20-22, these figures depict an additional embodiment. FIG. 20 is a perspective view of a hinged leg in one embodiment. FIG. 21 is a perspective view of a hinged leg in a retracted position in one embodiment, and FIG. 22 is a perspective view of a hinged leg in an extended position in one embodiment.

These figures depict an embodiment wherein the legs can easily be converted from a flexible to a rigid position. As discussed previously, a flexible position allows the legs to flex about the flexible joint 383 whereas a rigid position prevents the flexible joint 383 from flexing. Being able to quickly quick between positions is an advantage which allows the user to accommodate various shooting positions, angles, etc.

As shown in FIG. 20, the leg 48 is coupled to a locking pin 376 which transitions the leg from a rigid to a flex position. This will be described in more detail below.

As depicted, the lock 370 comprises a generally hollow piece which houses the upper end of the legs 48. The upper end of the legs 48 are coupled, in one embodiment, to the lock 370 via a locking pin 376. As depicted the lock 370 further comprises a housing 379 which is located within the lock 370. The housing 370 is hollow and it can receive at least a portion of the flexible joint 383 when the leg is in the rigid position. Coupled to the flexible joint 383 is a locking pin 376. While a pin is described, this is for illustrative purposes only and should not be deemed limiting. The location of the locking pin 376 relative to the housing 379 allows the leg to be in either the flex or rigid position.

As depicted the housing 379 has two locking openings: an upstream locking opening 378 and a downstream locking opening 377. As depicted, and in one embodiment, the openings 378, 377 comprise an indentation cut into the housing 379. In one embodiment the openings are located on the outer and opposite ends of the housing 379. As depicted the two openings are connected via a channel 384. The locking pin 376 is allowed to travel through the channel 384. In one embodiment the channel extends completely through between the inner diameter and the outer diameter of the housing 379. In one embodiment the channel extends lengthwise between the two opposing openings 378, 377.

When the locking pin 376 is inserted such that the locking pin 376 engages the upstream locking opening 378, the flexible joint 383 is housed within the lock 370. As discussed, this prevents flexing of the flexible joint 383. Accordingly, the leg is in the rigid position. In the embodiment depicted, to lock the leg into the rigid position the leg is pressed inward relative to the flexible joint 383, and then the leg is twisted clock-wise. This sets the locking pin 376 into the upstream locking opening 378. As noted, because the flexible joint 383 is rigidly maintained in the cavity of the lock 370, flexing about the flexible joint 383 is prevented. As such, the leg is in the rigid position.

The leg can be maintained and coupled within and/or to the lock 370 via any method or device known in the art. In one embodiment the upstream end 373 comprises an outer diameter which is larger than the inner diameter at the downstream end of the lock 370. This and other methods allow the leg to be properly secured.

If a user rotates the leg in a counter-clock-wise direction and pulls outwardly relatively to the lock 370, then the pocking pin 376 will follow the narrow channel in the housing 379. When the user rotates the leg clock-wise, the locking pin 376 engages with the downstream locking opening 377. This secures the leg in the flex position. As can be seen, in this instance, at least a portion of the flexible joint 383 will be exposed, and will not be confined by the flexible joint 383. As such, the flexible joint 383 is free to flex and bend. In one embodiment a majority of the flexible joint 383 is exposed and free to flex. In still other embodiments, the entirety of the flexible joint 383 is exposed and free to flex.

While one embodiment has been described wherein the housing 379 comprises two openings connected by a narrow channel, this is for illustrative purposes only and should not be deemed limiting. Other designs which allow for locking and adjusting the leg relative to the lock 370 can also be utilized.

The design described above allows a user to quickly and easily convert from a rigid position to a flex position and vice versa. Additionally, the user can quickly and easily lock the leg in the desired position. With the system described herein, no additional tools are necessary for the conversion. This is an advantage because the user need not carry additional tools.

As noted, the lock 370 is coupled to a coupler 381. As depicted the lock 370 is hingedly coupled to the coupler 381 via a hinge point 375. The hinge point 375 can comprise any screw, bolt, etc. In one embodiment the hinge point is adjustable so that the tension can be adjusted. In one example, this allows the leg to be fixed in an extended or retracted position. As noted, in one embodiment the hinged point is a fixed hinged point. Thus, the lock 370 rotates relative to the coupler 381 via the hinge point 381.

The coupler 381 can comprise any device which can couple the leg, or pair of legs, to a firearm. There can be one coupler 381 per leg, or a single coupler 381 can be attached to a pair of legs. The coupler 381 can attach to a firearm via any method or device known in the art.

As depicted the coupler 381 comprises an anchor 371. The anchor 371 is a fixed element which engages the lock 370. As depicted, the lock 370 comprises two anchor points 382. An anchor point 371, as depicted, is an indentation in the lock 370 which mates with and engages the anchor 371. The leg orientation, either extended or retracted, can be controlled by adjusting the anchor point 382 relative to the anchor.

Turning now to FIG. 21, the anchor 371 is engaged with the retracted anchor point 382*a*. The retracted anchor point 382*a* is the anchor point which results in the leg being in the retracted position. In the figure depicted, the retracted anchor point 382 is the upper anchor point. Thus, the retracted anchor point 382 is above the lower extended anchor point 382*b*. As can be seen in FIG. 21, in the embodiment depicted the leg 48 is approximately parallel with the coupler 381. The leg 48 is also approximately parallel with the rail 380 and or the barrel (not depicted) when in the retracted position.

Turning now to FIG. 22, the anchor 371 is now engaged with the extended anchor point 382*b* which is the lower anchor point. Accordingly, the leg 48 is now in the extended position. The leg 48 is not parallel with the coupler 381, the rail 380, or the barrel depicted.

Figure 23:
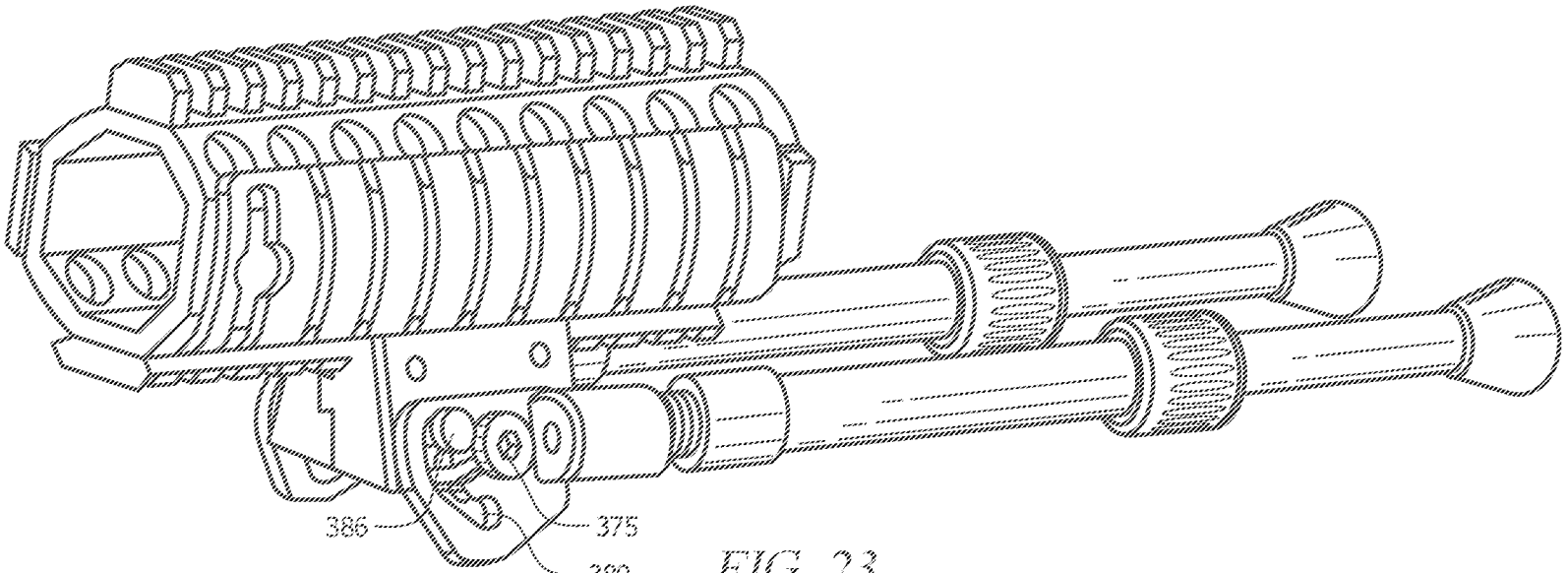
FIG. 23 is a perspective view of a hinged leg in a retracted position in one embodiment.
Figure 24:
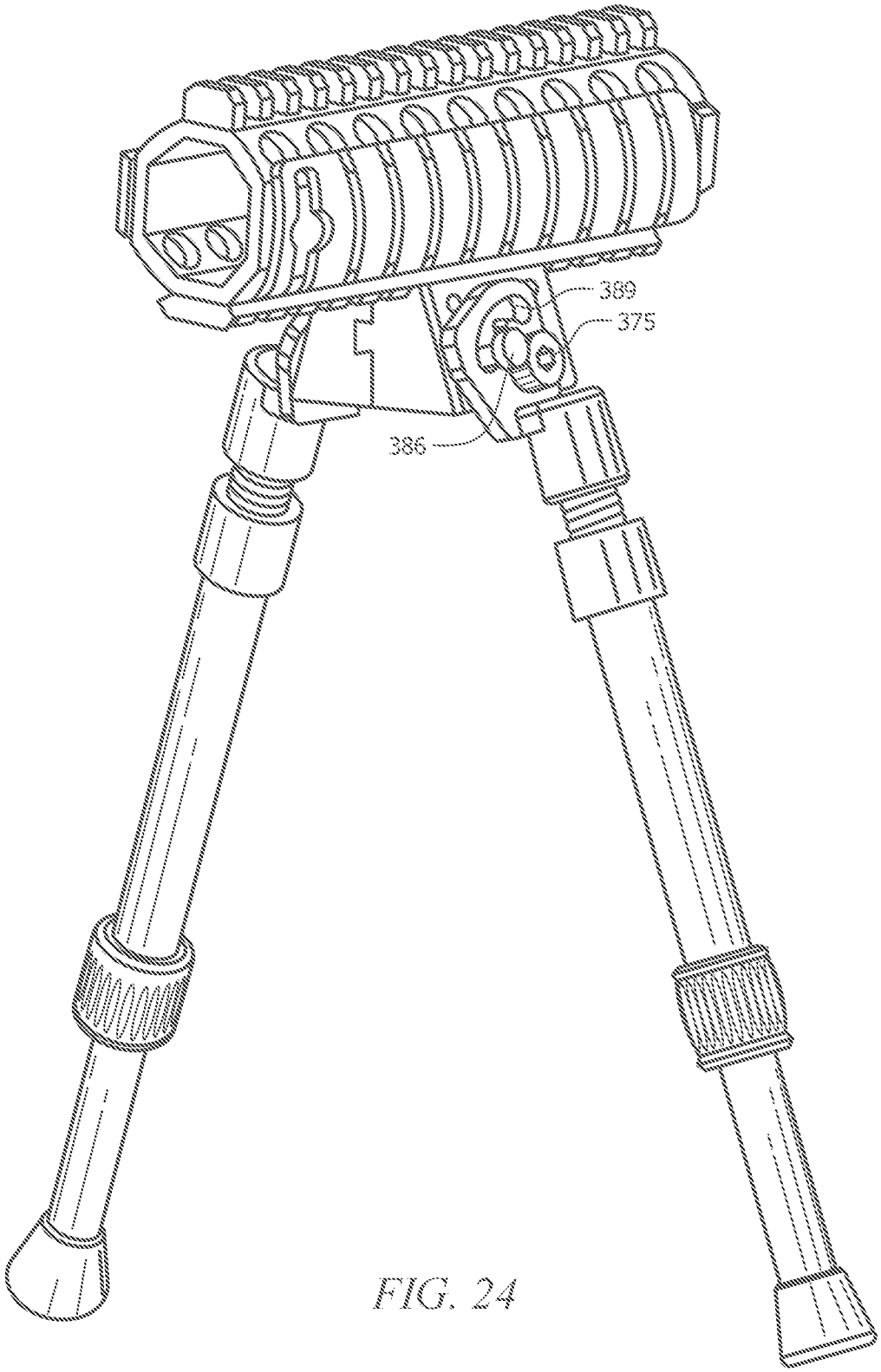
FIG. 24 is a perspective view of a hinged let in an extended position in one embodiment.
Figure 25:
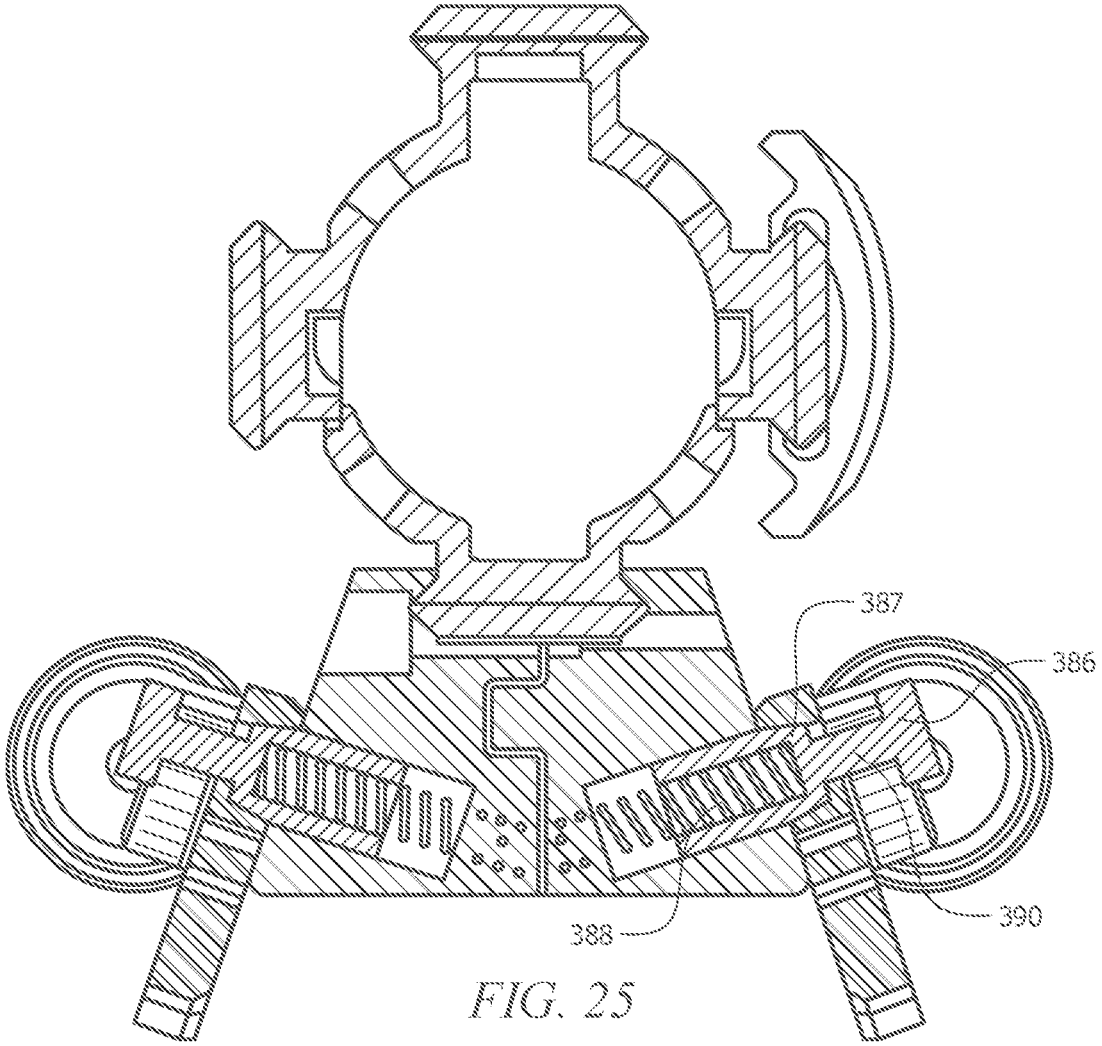
FIG. 25 is a cross-section view of the button in one embodiment.

Now turning to FIGS. 23-25, these figures illustrate another embodiment in controlling the orientation of the legs. FIG. 23 is a perspective view of a hinged leg in a retracted position in one embodiment, and FIG. 24 is a perspective view of a hinged let in an extended position in one embodiment. In these figures the legs rotate about a hinge point 375 as previously described. In this embodiment, the legs are maintained in the desired orientation by a button 385. The legs are in communication with the button 386 via a channel 389. The legs pivot about the fixed button 386 via the channel 389.

The button 386 maintains the legs in the retracted orientation as depicted in FIG. 23. When the button is depressed, the legs can pivot about hinge point 375 and fall into the extended position of FIG. 24. The button maintains the legs in the extended position of FIG. 24 until a button is pressed again. Thus, as shown, the same button locks the legs in the desired orientation. The same button is then depressed to change leg orientations.

Turning to FIG. 25, FIG. 25 is a cross-section view of the button in one embodiment. As can be seen the button 386 has a reduced diameter portion 390 and an enlarged diameter portion 387. When the enlarged diameter portion 387 is urged forward by a spring 388, the enlarged diameter portion 387 prevents the channel 386 from moving around the button 386. This maintains the legs in the specified orientation. However, upon pressing the button 386, this compresses the spring 388. This aligns the reduced diameter portion 390 with the channel, and allows the channel 386 to pass around the reduced diameter portion 390 which is smaller than the reduced width of the channel 386. In one embodiment the enlarged diameter portion 387 has a diameter greater than the width of the reduced width of the channel 386. In this fashion, the orientation of the legs can be changed and maintained by pressing a single button.

While a bipod has been described, this is for illustrative purposes only and should not be deemed limiting. In one embodiment the system described herein only has one leg as opposed to the two legs described with a bi-pod. In one embodiment the system comprises one or more shooting sticks. A shooting stick, as used herein, refers to a leg which can offer support to a shooter when operating a firearm as described above. As noted, the firearm can include, but is not limited to, a rifle, shotgun, archery devices, etc. The shooting stick, in one embodiment, is moveable between two positions.

In one embodiment the shooting stick is convertible from a flexible to a rigid position. As discussed previously, a flexible position allows the leg to flex about the flexible joint 383 whereas a rigid position prevents the flexible joint 383 from flexing. Being able to quickly switch between positions is an advantage which allows the user to accommodate various shooting positions, angles, etc. Even in embodiments where only a single shooting stick is used, as opposed to a bipod, the ability to switch quickly from a rigid to flexible position, and vice versa, is an advantage.

While current embodiments of a bipod firearm support have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a single button activating two latches simultaneously and two buttons activating two latches independently have been described, it should be appreciated that the invention can also include a single button activating a single latch that extends into both bore segments, or a single button activating two separate latches that can independently assume the latched and unlatched positions. Furthermore, a rigid cord with a tension spring or rubber can be used instead of the elastic cord described. In addition, the support legs may have interchangeable feet to adapt the support legs to a variety of terrain. Finally, the bipod firearm support of the invention could be an integral portion of the stock or forearm of the firearm in alternative embodiments.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

Clause 1. A system comprising:

a coupler used for coupling at least one leg to a firearm;

wherein said at least one leg comprises an upstream end and a downstream end separated by flexible joint;

a lock which couples with said flexible joint;

wherein said leg is convertible from a rigid position wherein said lock prevents said flexible joint from flexing to a flexible position wherein said lock does not prevent said flexible joint from flexing.

Clause 2. The system of any proceeding or preceding clause wherein said flexible joint comprises a coil.

Clause 3. The system of any proceeding or preceding clause further comprising a hinge whereby said at least one leg can rotate relative to said coupler.

Clause 4. The system of any proceeding or preceding clause further comprising a fixed hinge point which allows rotation of said hinge relative to said coupler.

Clause 5. The system of any proceeding or preceding clause wherein said fixed hinge point comprises an adjustable bolt.

Clause 6. The system of any proceeding or preceding clause further comprising a biasing mechanism.

Clause 7. The system of any proceeding or preceding clause wherein said lock is moveable along said leg, and whereby movement of the lock relative to the flexible joint determines if the leg is in the rigid position or the flexible position.

Clause 8. The system of any proceeding or preceding clause wherein said lock surrounds the flexible joint when in the rigid position, and wherein said lock does not surround the flexible joint when in the flexible position.

Clause 9. The system of any proceeding or preceding clause wherein said lock comprises a hollow member which completely receives said flexible joint when in said rigid position, wherein said at least one leg is coupled to a locking pin which secures said leg in said rigid and said flexible positions.

Clause 10. The system of any proceeding or preceding clause further comprising a housing located within said lock, wherein said housing comprises an upstream locking opening and a downstream locking opening, wherein said upstream locking opening engages said locking pin when the at least one leg is in the rigid position, and wherein said downstream locking opening engages said locking pin when the at least one leg is in the flexible position.

Clause 11. The system of any proceeding or preceding clause wherein said upstream locking opening and said downstream openings are located on opposing sides of said housing and each comprise an indentation, and wherein the openings are connected via a channel, and wherein said locking pin is manipulated to travel through said channel to engage either said upstream locking opening or said downstream locking opening.

Clause 12. The system of any proceeding or preceding clause wherein said leg is rotated to allow said locking pin to engage said upstream locking opening.

Clause 13. The system of any proceeding or preceding clause further comprising a hinge which couples to said coupler, and wherein said coupler comprises an anchor, and wherein said hinge comprises two anchor points which engage with the anchor.

Clause 14. The system of any proceeding or preceding clause wherein said at least two anchor points comprise indentations in the hinge, wherein the at least two anchor points comprise an upper anchor point and a lower anchor point, wherein said at least one leg is in a first retracted orientation when said upper anchor point is engaged with the anchor, and wherein the at least one leg is in a second extended orientation when said lower anchor point is engaged with the anchor.

Clause 15. The system of any proceeding or preceding clause wherein said second orientation is separated by at least 30 degrees from said first orientation.

Clause 16. The system of any proceeding or preceding clause wherein said coupler is coupled to a firearm, wherein said at least one leg is rotatable relative to said firearm from a retracted orientation to an extended orientation, and wherein a majority of said leg is not housed in a housing in either orientations.

Clause 17. The system of any proceeding or preceding clause wherein said at least one leg comprises two legs.

What is claimed is:

1. A system comprising:

a coupler used for coupling at least one leg to a firearm;

wherein said at least one leg comprises an upstream end and a downstream end separated by flexible joint;

wherein said at least one leg rotates about a hinge point which is located on a member, wherein said member is coupled to said upstream end, and wherein said hinge point comprises a bolt;

wherein said legs are maintained in a desired orientation by a button;

wherein said button is generally cylindrical and has a length, and wherein said button and has a reduced diameter portion and an enlarged diameter portion offset against the length of said button, and wherein said reduced diameter portion can pass through said channel;

and wherein said button is in communication with a channel located on said member, and wherein said button moves through said channel;

wherein said flexible joint comprises a coil, and wherein said coil allows each leg to flex and pivot at the coil.

2. The system of claim 1 further comprising a biasing mechanism.

3. The system of claim 1 comprising a first orientation and a second orientation, wherein said second orientation is separated by at least 30 degrees from said first orientation.

4. The system of claim 1 wherein a majority of said leg is not housed in a housing in either orientations.

5. The system of claim 1 wherein said at least one leg comprises two legs.

6. The system of claim 1 wherein said channel is located on said coupler.

7. The system of claim 1 wherein said enlarged diameter portion is urged forward by a spring.

8. The system of claim 1 wherein said enlarged portion prevents said channel from moving around the button.

9. The system of claim 8 wherein when said button is pressed, the spring is compressed and the reduced diameter portion aligns with the channel, allowing the button to pass through the channel.

* * * * *